US011255151B2

(12) United States Patent
Nichols et al.

(10) Patent No.: US 11,255,151 B2
(45) Date of Patent: Feb. 22, 2022

(54) FLAPPER ON FRAC PLUG THAT ALLOWS PUMPING DOWN A NEW PLUG

(71) Applicant: Halliburton Energy Services, Inc., Houston, TX (US)

(72) Inventors: Matthew Taylor Nichols, Carrollton, TX (US); Nin M. Nguyen, Carrollton, TX (US); Zachary William Walton, Edmond, OK (US); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 14 days.

(21) Appl. No.: 16/800,358

(22) Filed: Feb. 25, 2020

(65) Prior Publication Data

US 2021/0054714 A1 Feb. 25, 2021

Related U.S. Application Data

(60) Provisional application No. 62/890,991, filed on Aug. 23, 2019.

(51) Int. Cl.

| | |
|---|---|
| ***E21B 34/06*** | (2006.01) |
| ***E21B 33/12*** | (2006.01) |
| ***E21B 33/129*** | (2006.01) |

(52) U.S. Cl.

CPC ..... *E21B 33/12* (2013.01); *E21B 33/1293* (2013.01); *E21B 34/063* (2013.01); *E21B 2200/04* (2020.05); *E21B 2200/05* (2020.05)

(58) Field of Classification Search

CPC ..... E21B 2200/05; E21B 34/06

See application file for complete search history.

(56) References Cited

U.S. PATENT DOCUMENTS 4,531,587 A * 7/1985 Fineberg ..... E21B 34/10 166/332.8

7,600,572 B2 10/2009 Slup et al.

(Continued)

FOREIGN PATENT DOCUMENTS

WO 2019023493 A1 1/2019

OTHER PUBLICATIONS

Nichols, Matthew Taylor et al., Filing Receipt, Specification and Drawings for U.S. Appl. No. 62/890,991, filed Aug. 23, 2019, titled "Flapper on Frac Plug that Allows Pumping Down A New Plug," 79 pages.

(Continued)

*Primary Examiner* — Catherine Loikith

(74) *Attorney, Agent, or Firm* — Conley Rose, P.C.; Rodney B. Carroll

(57) ABSTRACT

A zonal isolation device conveyed into the wellbore with a propped flapper valve. The zonal isolation device comprises a deformable sealing element and a support ring movably disposed within the inner bore of the sealing element. A flapper valve coupled to the support ring is configured to engage a sealing surface of support ring. The flapper valve blocks fluid flow through the zonal isolation device in a fully closed position, allows unrestricted fluid flow through the zonal isolation device in a fully open position, and allows restricted fluid flow through the zonal isolation device when held by a propping component in an intermediate or partially open position. The zonal isolation device is anchored to the wellbore by an anchoring assembly engaged with a wedge coupled to the downhole end of the sealing element.

16 Claims, 22 Drawing Sheets

(56) References Cited

U.S. PATENT DOCUMENTS

| | | | | |
|---|---|---|---|---|
| 8,869,904 | B2 | 10/2014 | Jani | |
| 8,893,796 | B2 * | 11/2014 | Conner | E21B 21/10 166/323 |
| 9,702,029 | B2 | 7/2017 | Fripp et al. | |
| 10,352,128 | B1 | 7/2019 | Saraya | |
| 2009/0242206 | A1 * | 10/2009 | Goughnour | E21B 34/06 166/332.8 |
| 2011/0277987 | A1 | 11/2011 | Frazier | |
| 2014/0110112 | A1 * | 4/2014 | Jordan, Jr. | E21B 33/12 166/281 |
| 2016/0258259 | A1 | 9/2016 | Walton et al. | |
| 2016/0341002 | A1 | 11/2016 | McKitrick, III | |
| 2017/0089175 | A1 | 3/2017 | Doane et al. | |
| 2017/0101849 | A1 * | 4/2017 | Silva | E21B 34/10 |
| 2018/0051532 | A1 | 2/2018 | Smith et al. | |

OTHER PUBLICATIONS

Foreign Communication from Related Application—International Search Report and Written Opinion of the International Searching Authority, International Application No. PCT/US2020/019933, dated Jun. 18, 2020, 13 pages.

* cited by examiner

FLAPPER ON FRAC PLUG THAT ALLOWS PUMPING DOWN A NEW PLUG

REFERENCE TO RELATED APPLICATIONS

This application claims priority to U.S. Provisional Patent Application No. 62/890,991, filed on Aug. 23, 2019, and titled "Flapper on Frac Plug That Allows Pumping Down a New Plug," the entirety of which is hereby incorporated by reference herein.

BACKGROUND

Wellbores are drilled into the earth for a variety of purposes including accessing hydrocarbon bearing formations. A variety of downhole tools may be used within a wellbore in connection with accessing and extracting such hydrocarbons. Throughout the process, it may become necessary to isolate sections of the wellbore in order to create pressure zones. Zonal isolation devices, such as frac plugs, bridge plugs, packers, and other suitable tools, may be used to isolate wellbore sections.

Frac plugs and other zonal isolation devices are commonly run into the wellbore on a conveyance such as a wireline, work string or production tubing. Such tools typically have either an internal or external setting tool, which is used to set the downhole tool within the wellbore and hold the tool in place. Upon reaching a desired location within the wellbore, the downhole tool is actuated by hydraulic, mechanical, electrical, or electromechanical means to seal off the flow of liquid around the downhole tool. After a treatment operation, zonal isolation devices may be removed from the wellbore by various methods, including dissolution and/or drilling. Certain zonal isolation devices may have numerous constituent parts, complicating removal. Some zonal isolation devices may include a ratchet or similar mechanism to retain the device in a set configuration. Ratchets may allow shifting or "free play" within each ratchet increment.

BRIEF DESCRIPTION OF THE DRAWINGS

These drawings illustrate certain aspects of some of the embodiments of the present disclosure, and should not be used to limit or define the claims.

Figure 1:
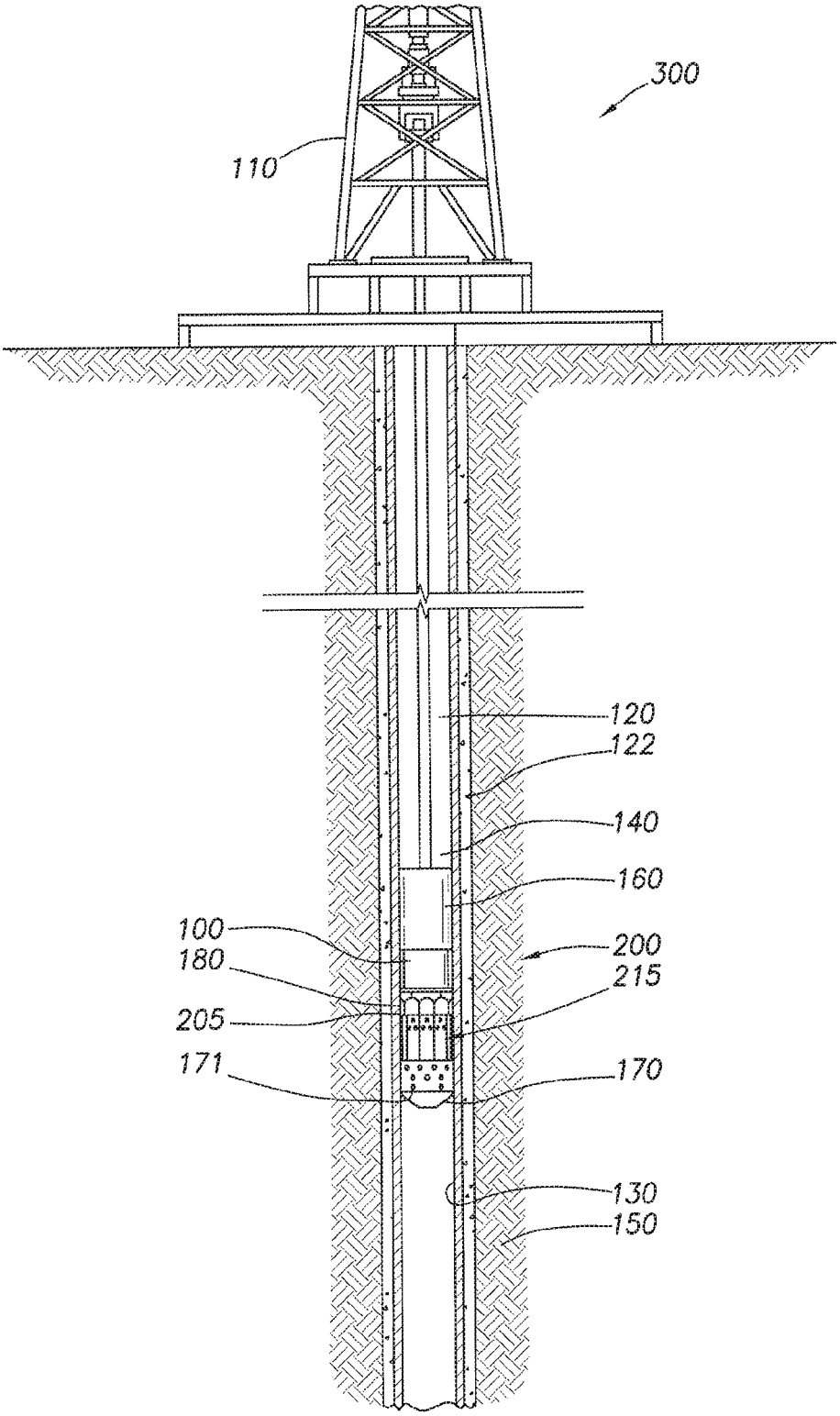
FIG. 1 is a diagram illustrating an environment for a zonal isolation device according to certain embodiments of the present disclosure.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DESCRIPTION OF CERTAIN EMBODIMENTS

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

As used herein, the terms "casing," "casing string," "casing joint," and similar terms refer to a substantially tubular protective lining for a wellbore. Casing can be made of any material, and can include tubulars known to those skilled in the art as casing, liner, and tubing. In certain embodiments, casing may be constructed out of steel. Casing can be expanded downhole, interconnected downhole and/or formed downhole in some cases.

As used herein, the term "downhole surface" and similar terms refer to any surface in the wellbore or subterranean formation. For example, downhole surfaces may include, but are not limited to a wellbore wall, an inner tubing string wall such as a casing wall, a wall of an open-hole wellbore, and the like.

As used herein, the term "degradable" and all of its grammatical variants (e.g., "degrade," "degradation," "degrading," "dissolve," dissolving," and the like), refers to the dissolution or chemical conversion of solid materials such that reduced-mass solid end products are formed by at least one of solubilization, hydrolytic degradation, biologically formed entities (e.g., bacteria or enzymes), chemical reactions (including electrochemical and galvanic reactions), thermal reactions, reactions induced by radiation, or combinations thereof. In complete degradation, no solid end products result. In some instances, the degradation of the material may be sufficient for the mechanical properties of the material to be reduced to a point that the material no longer maintains its integrity and, in essence, falls apart or sloughs off into its surroundings. The conditions for degradation are generally wellbore conditions where an external stimulus may be used to initiate or effect the rate of degradation, where the external stimulus is naturally occurring in the wellbore (e.g., pressure, temperature) or introduced into the wellbore (e.g., fluids, chemicals). For example, the pH of the fluid that interacts with the material may be changed by introduction of an acid or a base. The term "wellbore environment" includes both naturally occurring wellbore environments and materials or fluids introduced into the wellbore.

Directional terms, such as "up", "below", "downhole", etc. are used in the present disclosure. In general, use of the terms "up", "above", "upper", "uphole", "top", or other like terms refer to a direction toward the surface of the earth along a wellbore; likewise, "down", "lower", "below", "downhole", or other like terms refer to a direction away from the surface of the earth along the wellbore, regardless of the wellbore orientation. For example, in a horizontal wellbore, two locations may be at the same level (i.e., depth within a subterranean formation), the location closer to the well surface (by comparing the lengths along the wellbore from the wellbore surface to the locations) is referred to as "above" the other location.

As used herein, the term "coupled" and its grammatical variants refer to two or more components, pieces, or portions that may be used operatively together, that are joined together, that are linked together. For example, coupled components may include, but are not limited to components that are detachably coupled, shearably coupled, coupled by compression fit, coupled by interference fit, joined, linked, connected, coupled by a bonding agent. or the like.

The present disclosure relates to downhole tools used in the oil and gas industry. Particularly, the present disclosure relates to an apparatus for isolating zones in a wellbore and methods of use.

More specifically, the present disclosure relates to a zonal isolation device, comprising: a tubular body having a fluid communication pathway formed along a longitudinal axis comprising: a sealing element comprising a deformable material and an inner bore forming at least a portion of the fluid communication pathway; an expansion ring disposed within the bore of the sealing element; a wedge engaged with a downhole end of the sealing element; and an anchoring assembly engaged with the wedge. In certain embodiments, the tubular body further comprises an end element adjacent the anchoring assembly.

In some embodiments, the present disclosure relates to a method comprising: inserting into a wellbore a zonal isolation device disposed on a setting tool adapter kit comprising a mandrel, wherein the zonal isolation device comprises: a sealing element comprising a deformable material and an inner bore; an expansion ring movably disposed within the inner bore of the sealing element; a wedge engaged with a downhole end of the sealing element; an anchoring assembly engaged with the wedge; and an end element adjacent the anchoring assembly and detachably coupled to the mandrel; and actuating to pull upwardly on the mandrel, wherein the upward movement of the mandrel longitudinally compresses the zonal isolation device, causing the expansion ring to axially move relative to the sealing element and radially expand the sealing element into a sealing engagement with a downhole surface.

In some embodiments, the present disclosure relates to a zonal isolation system, comprising: a setting tool adapter kit comprising a mandrel; a sealing element disposed on the mandrel for sealing engagement with a downhole surface; an expansion ring movably disposed on the mandrel and engaged with the sealing element; a wedge disposed on the mandrel; and an anchoring assembly disposed around the mandrel for locking engagement with a downhole surface.

Among the many potential advantages of the apparatus and methods of the present disclosure, only some of which are alluded to herein, the zonal isolation device of the present disclosure may be provided with fewer component parts. Further, a zonal isolation device according to certain embodiments of the present disclosure may include a large inner diameter than other devices, which may prove advantageous for increasing flow rates during production operations. Further, a zonal isolation device according to certain embodiments of the present disclosure may be provided with more controlled dissolution characteristics due to, for example, fewer components parts. In some embodiments, the zonal isolation device of the present disclosure may retain a set configuration without a ratchet or similar mechanism, which may result in a lower cost tool with better dissolution characteristics and/or may eliminate the shifting that may occur in devices with a ratchet. In some embodiments, the zonal isolation device of the present disclosure may provide a more stable set frac plug, as the sealing element may provide additional stability.

The zonal isolation device is generally depicted and described herein as a hydraulic fracturing plug or "frac" plug. It will be appreciated by those skilled in the art, however, that the principles of this disclosure may equally apply to any of the other aforementioned types of casing or borehole isolation devices, without departing from the scope of the disclosure. Indeed, the zonal isolation device may be any of a frac plug, a wellbore packer, a deployable baffle, a bridge plug, or any combination thereof in keeping with the principles of the present disclosure.

Embodiments of the present disclosure and their advantages are best understood by references to FIGS. 1, 2, 3, 4, 5, 6, 7, 8, 9, 10, 11, 12, 13, 14, and 15, where like numbers are used to indicate like and corresponding features.

Representatively illustrated in FIG. 1 is a zonal isolation device employed in a wellbore system 300 according to certain embodiments of the present disclosure. A wellbore system 300 for sealing a zonal isolation device in a wellbore includes a service rig 110 extending over and around a wellbore 120. The service rig 110 may comprise a drilling rig, a completion rig, a workover rig, or the like. In some embodiments, the service rig 110 may be omitted and replaced with a standard surface wellhead completion or installation, without departing from the scope of the disclosure. The wellbore 120 is within a subterranean formation 150 and has a casing 130 lining the wellbore 120, the casing 130 held into place by cement 122. In some embodiments, the wellbore casing 130 may be omitted from all or a portion of the wellbore 120 and the principles of the present disclosure may alternatively apply to an "open-hole" environment. Although shown as vertical, the wellbore 120 may include horizontal, vertical, slant, curved, and other types of wellbore 120 geometries and orientations. As depicted, the zonal isolation device 200 may include a tubular body 205 comprising a sealing element 100, a wedge 180, an anchoring assembly 215, and an end element 170. The zonal isolation device 200 may be coupled to a setting tool adapter kit 160 for conveyance into the wellbore and setting. The setting tool adapter kit 160 may comprise a mandrel that may engage with the zonal isolation device 200. The zonal isolation device 200 and the setting tool adapter kit 160 may be moved down the wellbore 120 via a conveyance 140 that extends from the service rig 110 to a target location. The conveyance 140 can be, for example, tubing-conveyed, wireline, slickline, work string, or any other suitable means for conveying zonal isolation devices into a wellbore. In certain embodiments, the conveyance 140 may comprise a setting tool and be coupled to setting tool adapter kit 160. As an alternative, in some embodiments, a conveyance 140 is not used and the entire zonal isolation device 200 is pumped to location as an untethered device. As depicted in FIG. 1, the setting tool is an internal setting tool, but a person of skill would understand that an external setting tool could be used in one or more embodiments of the present disclosure. Examples of suitable setting tools for certain embodiments of the present disclosure include, but are not limited to Baker 10, Baker 20, 3½ HES GO, and the like, or any other suitable setting tool. In some embodiments, the zonal isolation device 200 may be pumped to the target location using hydraulic pressure applied from the service rig 110. In such embodiments, the conveyance 140 serves to maintain control of the zonal isolation device 200 as it traverses the wellbore 120 and provides the necessary power to actuate and set the zonal isolation device 200 upon reaching the target location. In other embodiments, the zonal isolation device 200 freely falls to the target location under the force of gravity. Upon reaching the target location, the zonal isolation device 200 may be actuated or "set" and thereby provide a point of fluid isolation within the wellbore 120. Setting may occur by longitudinal compression of the tubular body 205, which may move the sealing element 100 into sealing engagement with one or more downhole surfaces, and may also move the anchoring assembly 215 into locking engagement with one or more downhole surfaces. After setting, the setting tool adapter kit 160 may disengage from the zonal isolation device 200 and be withdrawn from the wellbore 120.

The zonal isolation device 200 of FIG. 1 is depicted in an unset configuration. In the unset configuration, the anchoring assembly 215 is configured such that the zonal isolation device can be moved uphole or downhole without catching on the casing 130 of the wellbore 120. Once the zonal isolation device 200 reaches the desired location, the setting tool adapter kit 160 may be actuated (e.g, by the setting tool) to set the zonal isolation device 200, anchoring it into place and moving it into a sealing engagement. It should be noted that while FIG. 1 generally depicts a land-based operation, those skilled in the art would readily recognize that the principles described herein are equally applicable to operations that employ floating or sea-based platforms and rigs, without departing from the scope of the disclosure. It should also be noted that a plurality of zonal isolation devices 200 may be placed in the wellbore 120. In some embodiments, for example, two or more zonal isolation devices 200 may be arranged in the wellbore 120 to divide the wellbore 120 into smaller intervals or "zones" for a particular operation (e.g., hydraulic stimulation).

Figure 2:
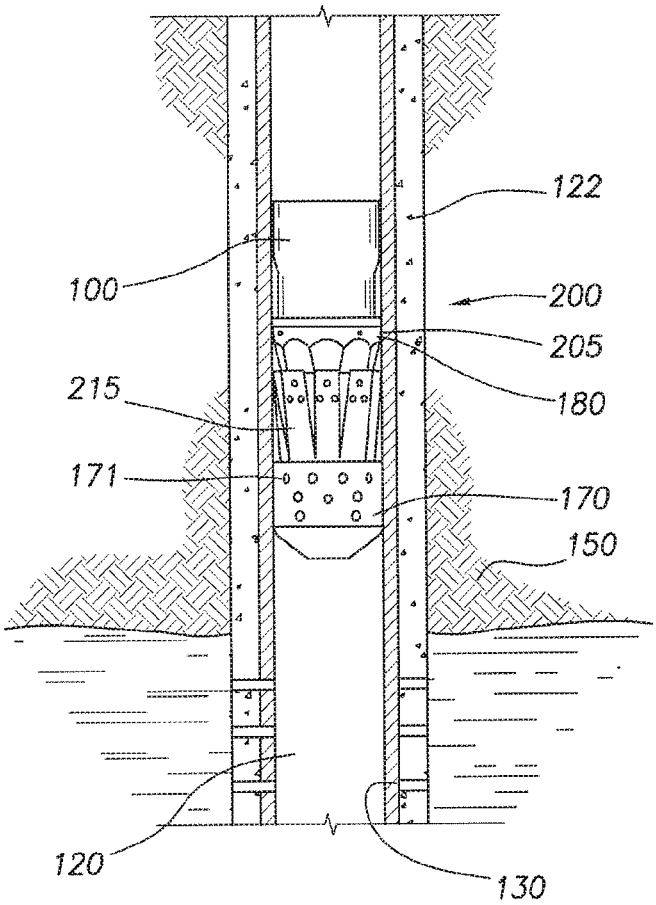
FIG. 2 is a diagram illustrating an environment for a set zonal isolation device according to certain embodiments of the present disclosure.

FIG. 2 depicts a zonal isolation device 200 in a set and anchored configuration disposed within a wellbore 120. In the anchored configuration, the anchoring assembly 215 is radially expanded outwards and engages and grips the casing 130 lining the wellbore 120. In the set configuration, the sealing element 100 is radially expanded outwards into sealing engagement with the casing 130 or other downhole surface. Sealing engagement of the sealing element 100 may effectively prevent fluid flow around the zonal isolation device 200. Although fluid may still flow through the internal bore of the zonal isolation device 200, a sealing device may be used to seal the internal flow of the zonal isolation device 200, as discussed further below. In such a manner, the zonal isolation device 200 may seal the wellbore 120 at a target location, preventing fluid flow past the zonal isolation device 200.

In some embodiments, the anchoring assembly 215 and sealing element 100 are sufficient to hold the zonal isolation device 200 in a set configuration, when in locking engagement and sealing engagement with a downhole surface, respectively. In certain embodiments, the zonal isolation device 200 may retain a set configuration without a ratchet or similar component.

FIGS. 3, 4, 5, 6, 7, 8, 9, 10, 11, 12, 13, 14, and 15 depict a zonal isolation device 200 according to certain embodiments of the present disclosure. The zonal isolation device 200 may include a tubular body 205 comprising a sealing element 100, wedge 180, anchoring assembly 215, end element 170, and expansion ring 190. The zonal isolation device 200 may include a fluid communication pathway 206 formed along a longitudinal axis. In some embodiments, one or more components of the zonal isolation device 200 may form at least a portion of the fluid communication pathway 206.

The sealing element 100 may comprise an inner bore 105 that forms at least a part of the fluid communication pathway 206. In certain embodiments, a wedge 180 may be adjacent to the downhole end 101 of the sealing element 100. The wedge 180 and the sealing element 100 may be coupled or uncoupled. In some embodiments, wedge 180 and sealing element 100 may engage each other with interlocking tapered surfaces at an interface 102. In certain embodiments, wedge 180 and sealing element 100 may be coupled together by a compression fit or an interference fit. For example, wedge 180 and sealing element 100 may be longitudinally compressed together after the zonal isolation device 200 is set.

The sealing element 100 may be elastically or plastically deformable, and may be composed of any suitable elastically or plastically deformable material including, but not limited to, elastomers (including but not limited to rubber), polymers (including but limited to plastics), or metal. One of ordinary skill in the art will understand that the material selected and the deformable nature (elastic or plastic) is an understood design choice generally dictated by the application of the system and method described herein. Furthermore, one of ordinary skill in the art will understand that the material may be further selected to ease the removal of zonal isolation device 200 by, for example, choosing a material that easily broken up if drilled out or a material that is dissolvable.

Figure 4:
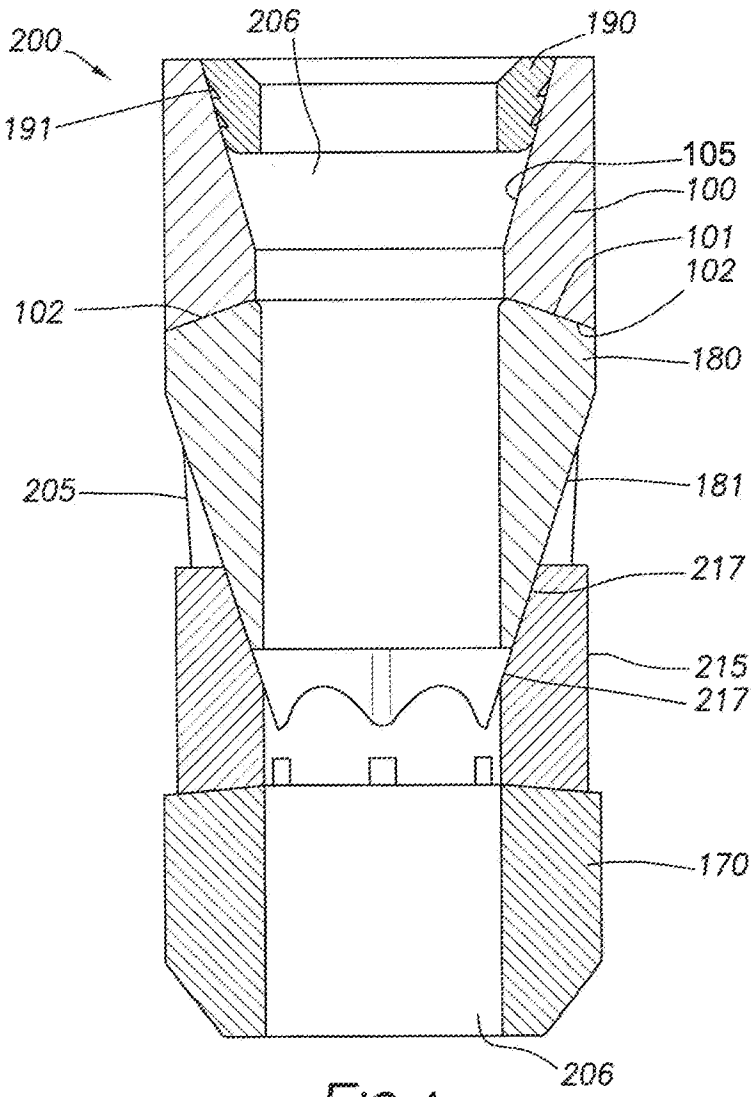
FIG. 4 is cross-sectional view of a zonal isolation device according to certain embodiments of the present disclosure.
Figure 5:
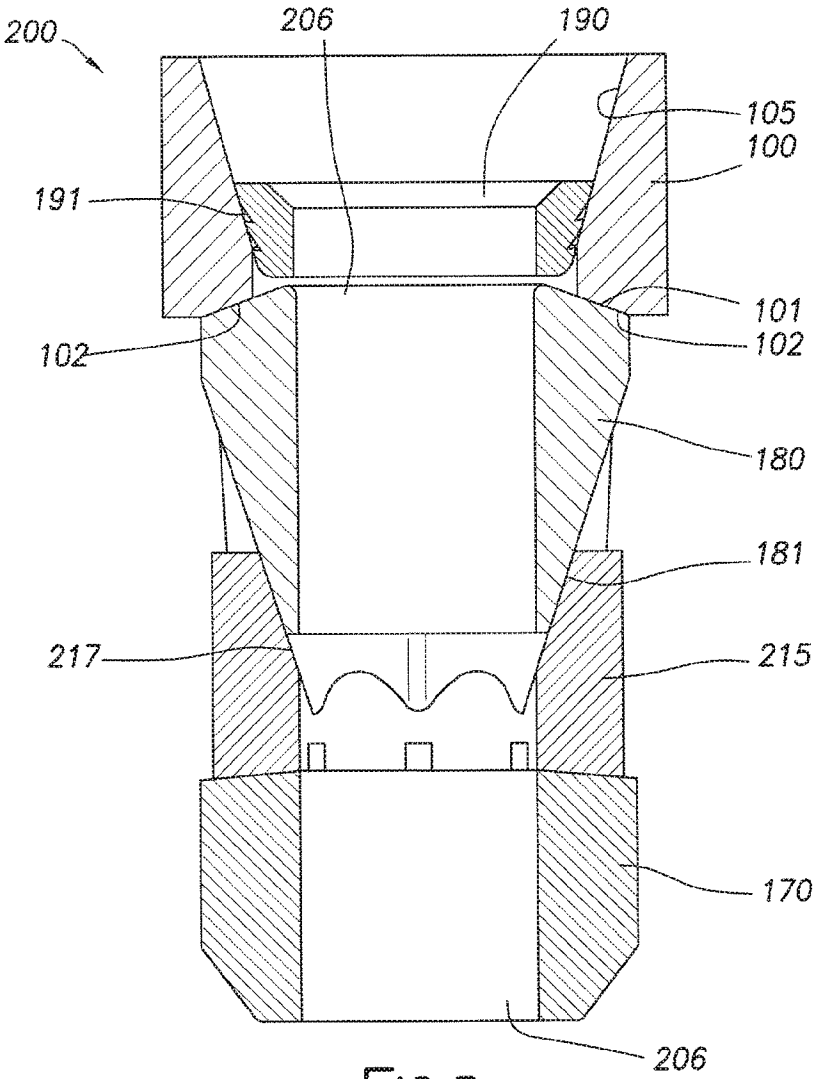
FIG. 5 is cross-sectional view of a zonal isolation device with an expanded sealing element according to certain embodiments of the present disclosure.

With reference to FIG. 4, the zonal isolation device may comprise an expansion ring 190. The expansion ring 190 may be disposed within the sealing element 100. In some embodiments, the expansion ring 190 may be movably disposed within an inner bore 105 of the sealing element 100. In an unset configuration of the zonal isolation device 200, the expansion ring 190 may be disposed adjacent to the sealing element 100, within the inner bore 105 of the sealing element 100, or partially disposed inside the sealing element 100. As shown in FIG. 5, the expansion ring 190 may cause the sealing element 100 to radially expand by moving towards the downhole end 101 of the sealing element 100. In certain embodiments, the expansion ring 190 may cause the sealing element 100 to radially expand into sealing engagement with a downhole surface. For example, setting the zonal isolation device 200 may cause the expansion ring 190 to axially move towards a downhole end 101 of the sealing element 100. The expansion ring 190 may be shaped such that engaging with a tapered inner surface of the inner bore 105 of the sealing element 100 radially expands the sealing element 100. The expansion ring 190 may comprise cuts or teeth 191 angled in an upwards orientation. The teeth 191 may engage with the inner bore 105 of the sealing element 100 and prevent upward movement of the expansion ring 190 relative to the sealing element 100. In some embodiments, the teeth 191 may allow the expansion ring 190 to maintain a position within the sealing element 100 in response to forces acting to remove it from the sealing element 100. Such forces may include, for example, a force caused during ejection of a ball or flow forces acting on the expansion ring 190 during flowback of fluids. In other applications, the sealing element 100 is attached to the wedge 180 (e.g., at interface 101/102) so that the expansion ring 190 causes the sealing element 100 to stretch into a frustrum shape. The interface 101/102 is affixed to each other, and the expansion ring 190 stretches the top of the sealing element 100 (e.g., rubber) while the bottom of the sealing element 100 (e.g., rubber) is bonded to the wedge 180.

Figure 7:
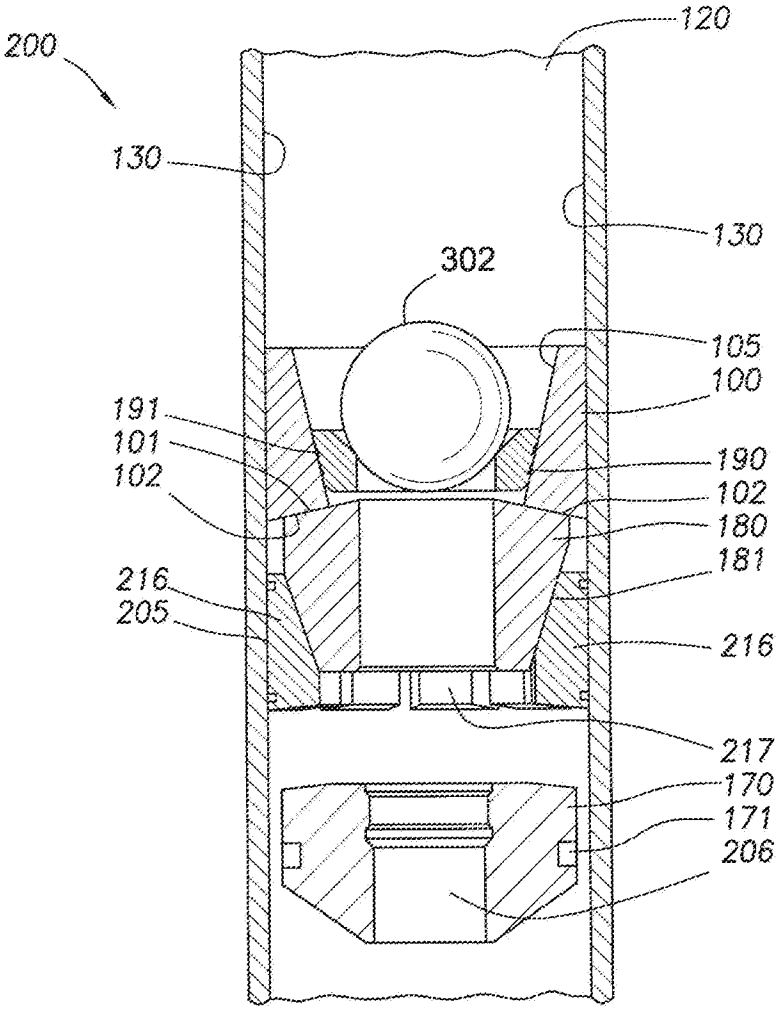
FIG. 7 is a cross-sectional view of a set zonal isolation device and a seated ball in a wellbore environment according to certain embodiments of the present disclosure.

In some embodiments, the expansion ring 190 may also act be configured to receive a sealing device (e.g., a frac ball, frac dart, or the like). As shown in FIG. 7, a sealing ball or "frac ball" 302 may be dropped and land on the expansion ring 190. As depicted, the sealing element 100 is in sealing engagement with the wellbore casing 130 and the slip segments 216 are in locking engagement with the casing 130. When the sealing ball 302 is seated on the expansion ring 190 and the zonal isolation device 200 is set, fluid flow past or through the zonal isolation device 200 in the downhole direction is effectively prevented. For example, the sealing ball 302 may seal off the fluid communication pathway 206 formed along a longitudinal axis of the zonal isolation device 200. At that point, wellbore operations such as completion or stimulation operations may be undertaken by injecting a treatment or completion fluid into the wellbore 120 and forcing the treatment/completion fluid out of the wellbore 120 and into a subterranean formation above the wellbore isolation device 200. For example, after the sealing ball 302 is seated, fluid may be introduced into the wellbore 120 at a pressure sufficient to create or enhance one or more fractures within the subterranean formation. In some embodiments, a different sealing device such as a frac dart may be used in place of the sealing ball 302.

Figure 3:
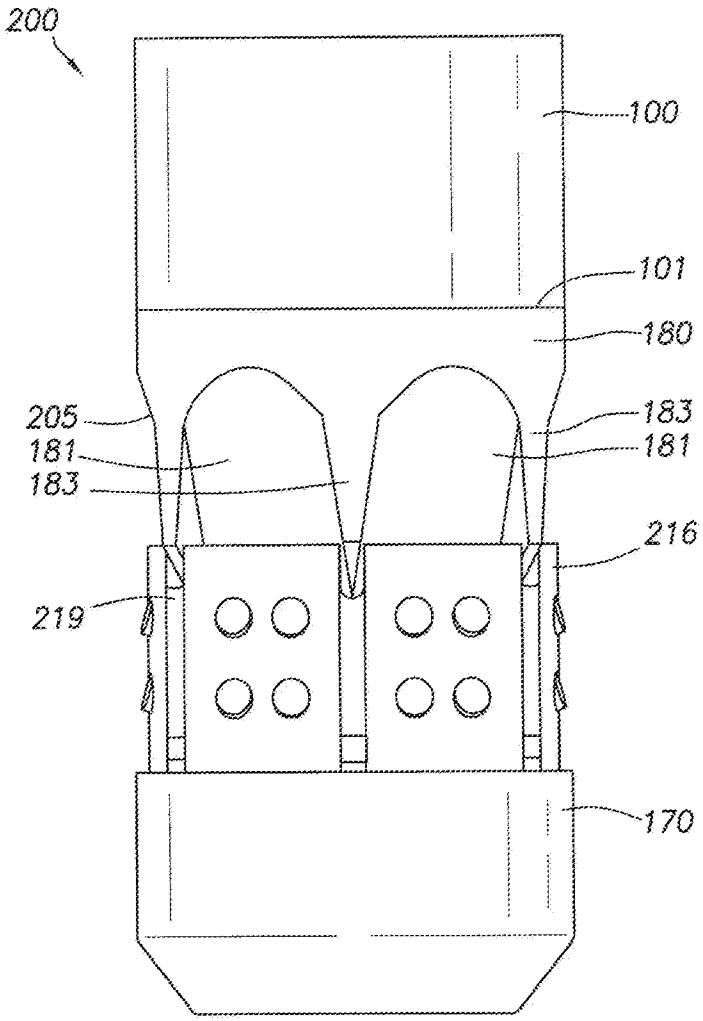
FIG. 3 is a side view of a zonal isolation device according to certain embodiments of the present disclosure.
Figure 8:
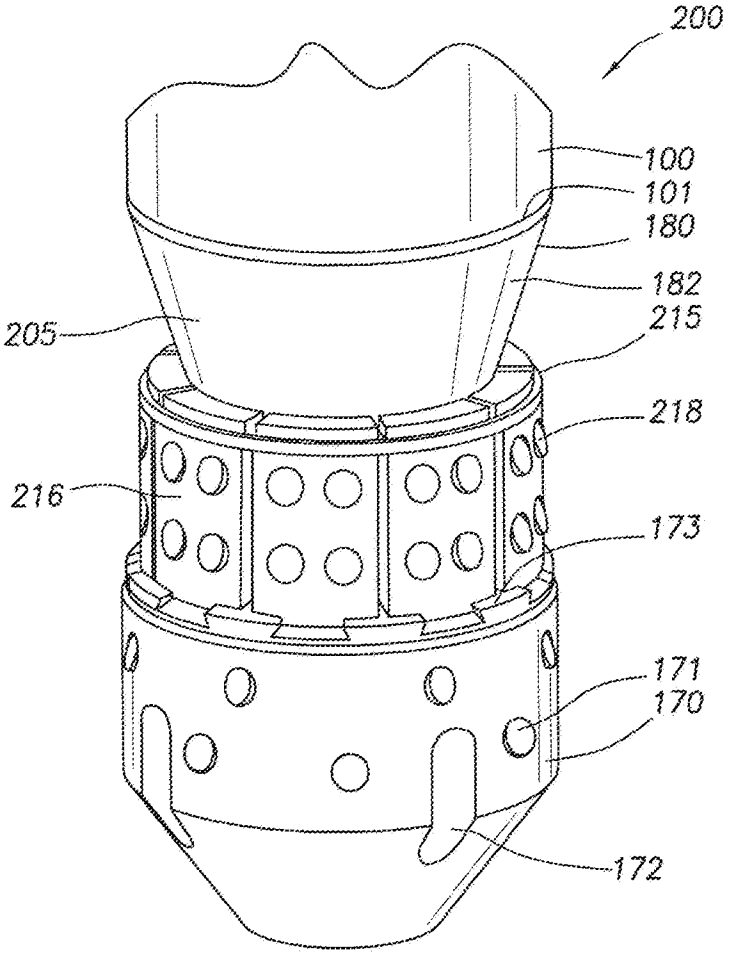
FIG. 8 is a perspective view of an unset zonal isolation device according to certain embodiments of the present disclosure.

The wedge 180 may have a frustoconical shape and be disposed between the sealing element 100 and the anchoring assembly 215. In certain embodiments, the anchoring assembly 215 is engaged with the wedge 180. In some embodiments, the wedge may be engaged with a downhole end 101 of the sealing element 100. In some embodiments, the wedge 180 may comprise a single frustoconical surface 182 (e.g., as depicted in FIG. 8). In other embodiments, the wedge 180 may include a plurality of planar tapered outer surfaces 181. In some embodiments, the planar tapered outer surfaces 181 may be finned and comprise fins 183 (e.g., as depicted in FIG. 3). The planar tapered outer surfaces 181 may correspond to at least a portion of the anchoring assembly 215. For example, each planar tapered outer surface 181 may correspond to and slidably engage with the inner surfaces 217 of a plurality of slip segments 216 of the anchoring assembly 215. In some embodiments, the planar tapered outer surfaces 181 and inner surfaces 217 of the anchoring assembly 215 may be complimentary, tapered, angled, or otherwise configured to engage one another upon setting of the zonal isolation device 200 in a wellbore (e.g., the wellbore 120 of FIG. 1). The planar tapered outer surface 181 and slip segments 216 may be shaped such that, upon sufficient movement of the wedge 180 relative to the slip segments 216, the slip segments 216 will be forced up the planar tapered outer surfaces 181 and radially expanded away from the wedge 180 towards a downhole surface.

In certain embodiments, the anchoring assembly 215 allows the zonal isolation device to hold its position within the wellbore. As depicted in FIG. 3, the anchoring assembly 215 may comprise a plurality of slip segments 216. Although depicted as arcuate-shaped slip segments 216, the slip segments 216 may be any suitable shape. The slip segments 216 may be deformed radially from the longitudinal axis of the zonal isolation device 200, thereby engaging a downhole surface such as a casing 130. The anchoring assembly 215 may be engaged by movement of the end element 170 upward, forcing a portion of the anchoring assembly 215 onto a portion of the wedge 180 and expanding the slip segments 216 outwardly toward the downhole surface. Expanding the slip segments 216 outwardly may move the anchoring assembly 215 into locking engagement with the downhole surface. The locking engagement of the anchoring assembly 215 may hold the zonal isolation device 200 in position after setting, preventing upward or downward movement in the wellbore 120.

Figure 6:
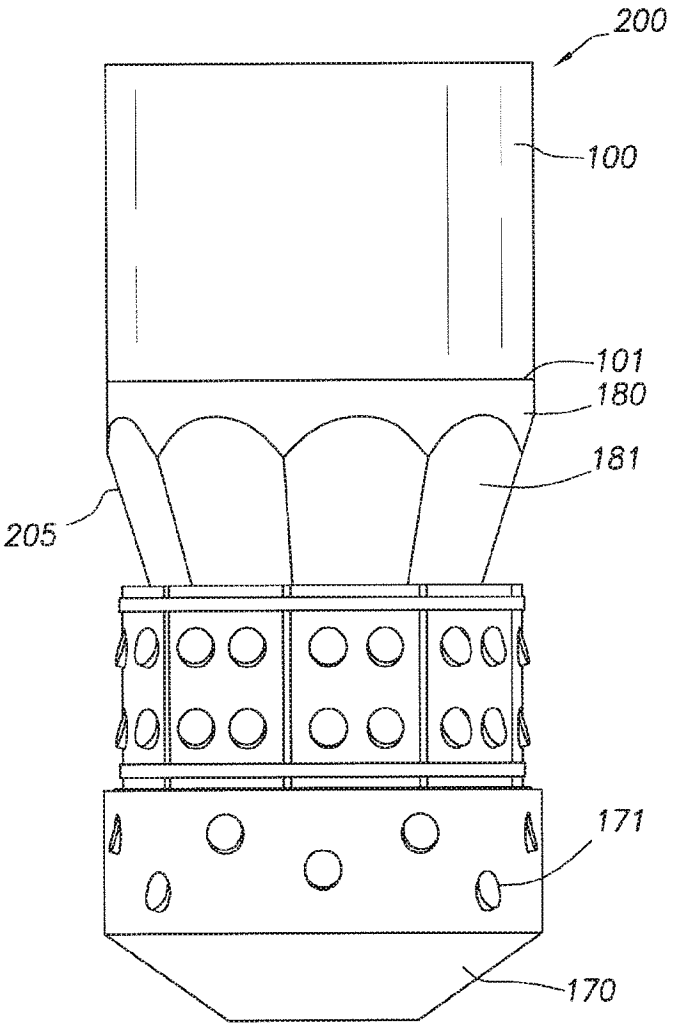
FIG. 6 is a side view of a zonal isolation device with linked slip segments according to certain embodiments of the present disclosure.

The plurality of slip segments 216 may be fully interconnected (e.g., as depicted in FIGS. 6 and 8), partially interconnected (e.g., as depicted in FIG. 3), or not connected. In some embodiments, at least two of the plurality of slip segments 216 may be interconnected by a shearable link 219 that may shear upon axial expansion of the slip segments 216. In certain embodiments, the sharable links 219 may be configured such that, upon sufficient movement of the wedge 180 relative to the slip segments 216, one or more fins 183 may shear one or more shearable links 219.

The slip segments 216 may comprise slip inserts 218 embedded therein. Slip inserts 218 may be wear buttons, wickers, wedges, or any other element for reducing wear of the slip segments 216. Slip inserts 218 may protrude from the slip segments 216 to penetrate or bite a downhole surface. Although each slip segment 216 is shown having four slip inserts 218 respectfully, it will be appreciated that any number of slip inserts, including one or a plurality (three, four, five, ten, twenty, and the like) of slip inserts may be embedded in each slip, without departing from the scope of the present disclosure. The slip segments 216 may have the same or a different number of slip inserts 218, without departing from the scope of the present disclosure. The slip inserts 218 in FIGS. 3, 6, and 8 are depicted as cylindrical. However, the slip inserts 218 may be squared shaped, frustum shaped, conical shaped, spheroid shaped, pyramid shaped, polyhedron shaped, octahedron shaped, cube shaped, prism shaped, hemispheroid shaped, cone shaped, tetrahedron shaped, cuboid shaped, and the like, and any combination thereof, without departing from the scope of the present disclosure. The slip inserts 218 may be partially one shape and partially one or more other shapes. In some embodiments, the slip inserts 218 may be hardened or coated to penetrate a downhole surface. For example, the slip inserts 218 may comprise a surface treatment including, but not limited to rough surfaces and edges, hardened coatings (both metallurgical and non-metallurgical bonded), ratchet teeth, etc.

In some embodiments, the slip inserts 218 may include hardened metals, ceramics, and any combination thereof. The material forming the slip inserts 218 may be an oxide or a non-oxide material. In certain embodiments, the thickness of a material may be increased in order to achieve the desired compressive strength. For example, in some embodiments the material forming the slip insert 218 may include, but is not limited to, iron (e.g., cast iron), steel, titanium, zircon, a carbide (e.g., tungsten carbide, a tungsten carbide alloy (e.g., alloyed with cobalt), silicon carbide, titanium carbide, boron carbide, tantalum carbide), a boride (e.g., osmium diboride, rhenium boride, tungsten boride, zirconium boride, iron tetraboride), a nitride (e.g., silicon nitride, titanium nitride, boron nitride, cubic boron nitride, boron carbon nitride, beta carbon nitride), diamond, synthetic diamond, silica (e.g., amorphous silica), an oxide (e.g., aluminum oxide, fused aluminum oxide, zirconium oxide, beryllium oxide, alumina-chrome oxide), corundite, topaz, synthetic topaz, garnet, synthetic garnet, lonsdaleite, and any combination thereof.

An end element 170 may be positioned at or secured at the downhole end of the zonal isolation device 200. As will be appreciated, the end element 170 of the wellbore isolation device 200 could be a mule shoe, or any other type of section that serves to terminate the structure of the wellbore isolation device 200, or otherwise serves as a connector for connecting the wellbore isolation device 200 to other tools, such as a valve, tubing, or other downhole equipment. The end element 170 may comprise end element inserts 171 embedded therein. End element inserts 171 may be wear buttons, wickers, wedges, or any other element for reducing wear of the end element 170. End element inserts 171 may be any shape or material discussed above with respect to slip inserts 218. In certain embodiments, the end element 170 may be adjacent, engaged with, and/or coupled to the anchoring assembly 215. For example, as shown in FIG. 8, the end element 170 may be coupled to the anchoring assembly 215 by a dovetail coupling 173. In some embodiments, as shown in FIG. 8, the end element 170 may include flow back channels 172 that allow flow back of fluids (e.g., production fluids).

Figure 9:
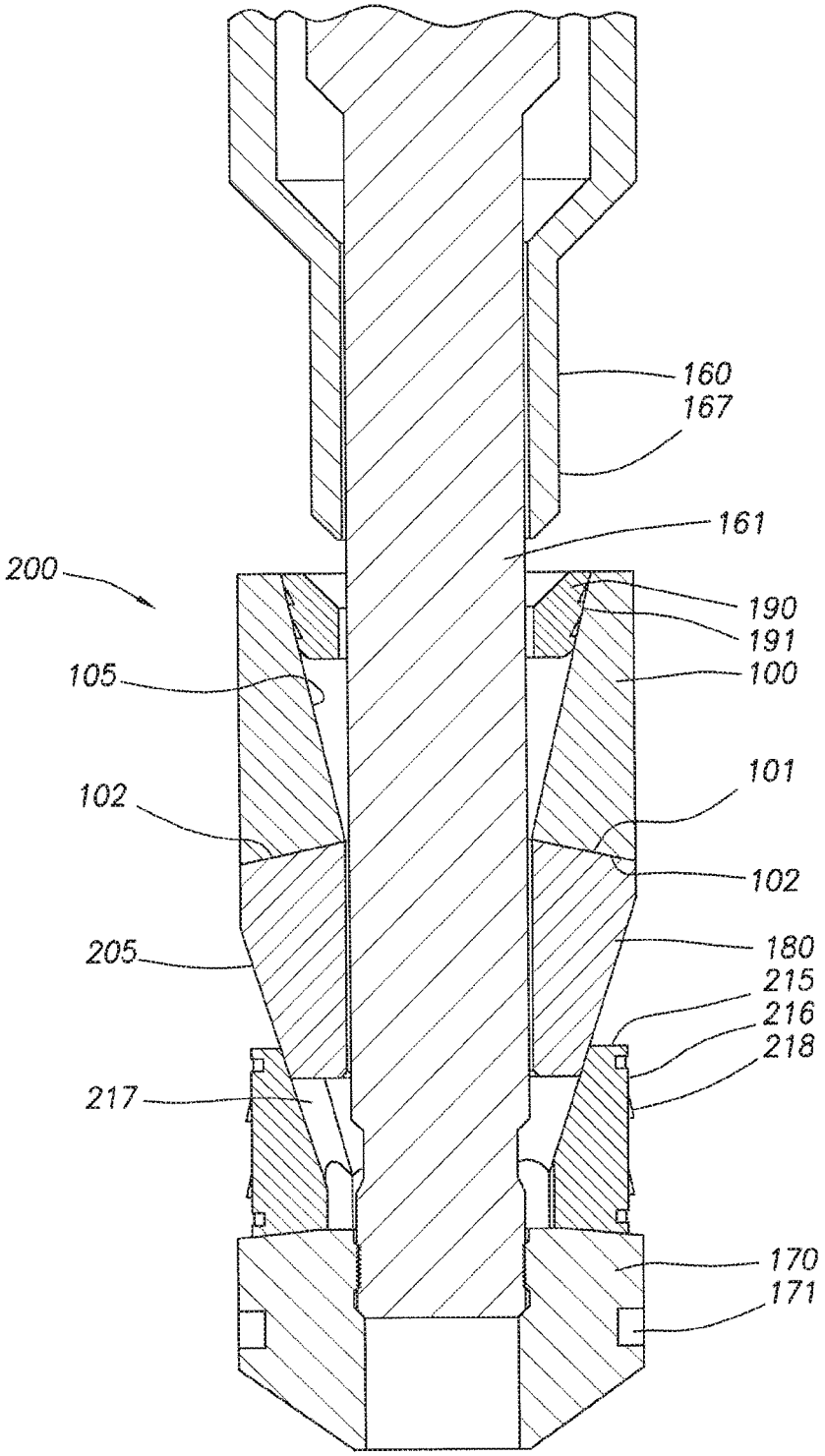
FIG. 9 is a cross-sectional view of a zonal isolation device engaged with a setting tool according to certain embodiments of the present disclosure.

With reference to FIG. 9, a setting tool adapter kit 160 may be coupled to the zonal isolation device 200. In some embodiments, the setting tool adapter kit 160 comprises a mandrel 161 that may engage with the zonal isolation device 200. In some embodiments, the setting tool adapter kit 160 comprises a setting sleeve 167 disposed around the mandrel 161. In certain embodiments, the mandrel 161 may be slidably engaged with the setting sleeve 167. In some embodiments, the mandrel 161 may be able to move relative to the setting sleeve 167. The setting tool adapter kit 160 may include parts that allow a conventional setting tool to be used with zonal isolation device 200. In certain embodiments, the mandrel 161 may be disposed within the zonal isolation device 200 along a longitudinal axis. In some embodiments, the mandrel 161 may be disposed in a fluid communication pathway 206 of the zonal isolation device 200. As depicted in FIG. 9, the mandrel 161 may be coupled to the end element 170. In some embodiments, the mandrel 161 may be detachably or shearably coupled to the end element 170. In certain embodiments, the mandrel 161 may be coupled to the end element 170 by shearable threads. As discussed above, the setting tool adapter kit 160 including mandrel 161 may be actuated upward to longitudinally compress the zonal isolation device 200. The setting tool or setting tool adapter kit 160 may operate via various mechanisms including, but not limited to, hydraulic setting, mechanical setting, setting by swelling, setting by inflation, and the like.

Figure 10:
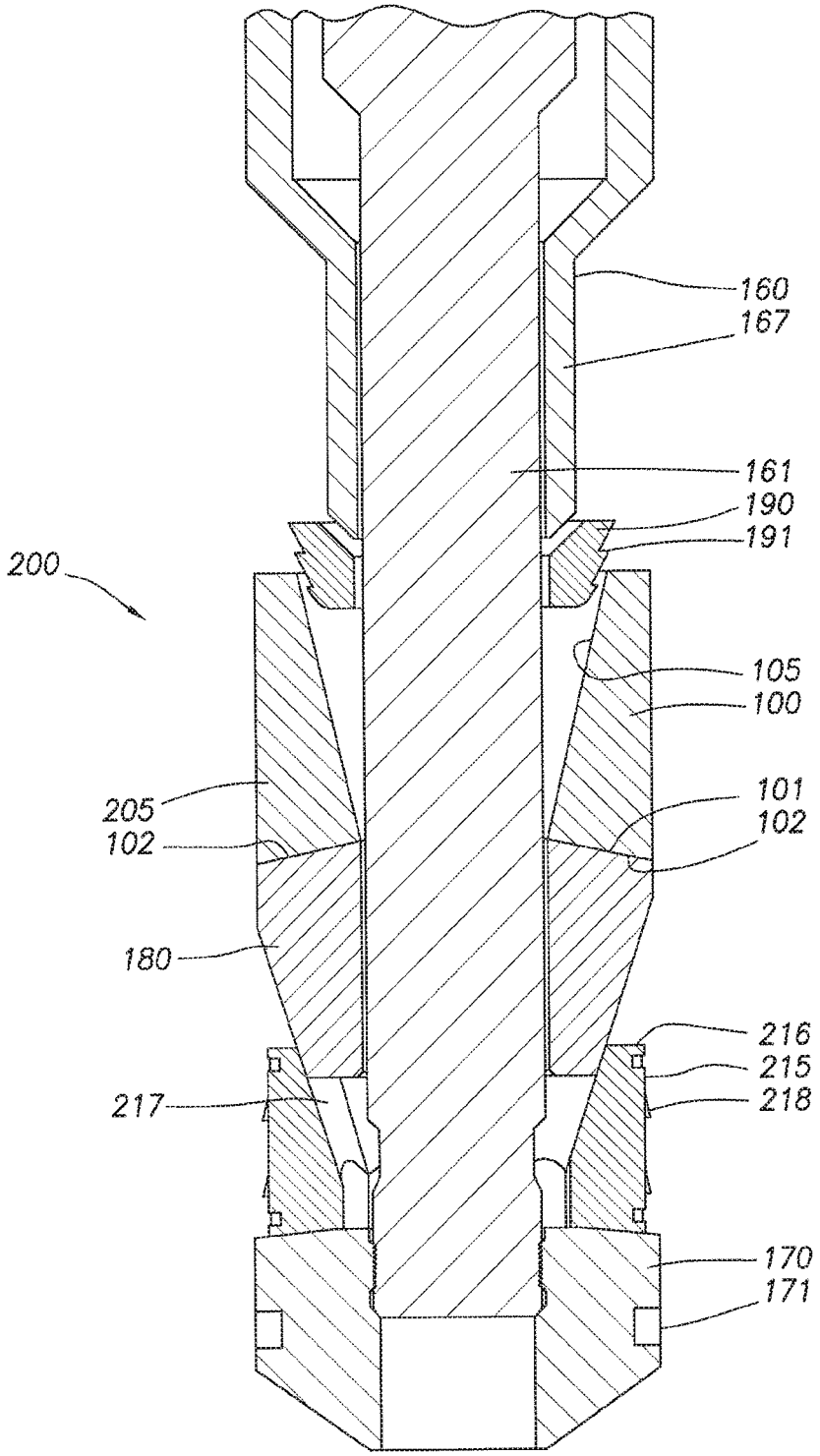
FIG. 10 is a cross-sectional view of a zonal isolation device having a floating expansion ring engaged with a setting tool according to certain embodiments of the present disclosure.

As depicted in FIGS. 9, 10, 11, 12, and 13, the components of the zonal isolation device 200 may be disposed on the mandrel 161. For example, the anchoring assembly 215, the wedge 180, the sealing element 100, and the expansion ring 190 may be disposed on or around the mandrel 161. In some embodiments, one or more of the anchoring assembly 215, the wedge 180, the sealing element 100, and the expansion ring 190 may be coupled (e.g., shearably coupled) to the mandrel 161. The expansion ring 190 may be coupled to the sealing element 100, as shown in FIG. 9, or uncoupled from the sealing element 100 or "floating," as shown in FIG. 10. In certain embodiments, the mandrel 161 may be coupled (e.g., by threads) to one or more components of the zonal isolation device 200 with a given level of tightness. In certain embodiments, the tightness of a coupling between the mandrel 161 and one or more components of the zonal isolation device 200 may be from about 0.5 ft·lb to about 50 ft·lb.

In some embodiments, one or more components of the setting tool adapter kit 160 or a setting tool coupled to the setting tool adapter kit 160 may be actuated to force the end element 170 upward by drawing the mandrel 161 upward. Drawing the end element 170 upward may force the anchoring assembly 215 upward such that the slip segments 216 engage with the wedge 180. For example, drawing the end element 170 upward may force the slip segments 216 up a surface of the wedge 180, causing the slip segments 216 to radially expand into locking engagement with a downhole surface.

In some embodiments, one or more portions of the setting tool adapter kit 160 may hold the expansion ring 190 stationary relative to the sealing element 100 and/or other elements of the zonal isolation device 200. In certain embodiments, the setting sleeve 167 may restrict upward movement of the expansion ring 190 during upward movement of the mandrel 161. For example, the setting tool 160 may comprise one or more retention elements shaped to restrict the upward movement of the expansion ring 190 during upward movement of the mandrel 161 and other components of the zonal isolation device 200. In certain embodiments, the retention element may include a ridge, flange, tab, pin, sleeve, or other element suitable to restrict upward movement of the expansion ring 190 during upward movement of the mandrel 161. Actuating the setting tool 160 may cause the sealing element 100 to move upward relative to the expansion ring 190, forcing the expansion ring 190 towards the downhole end 101 of the sealing element 100. Shifting of the expansion ring 190 towards the downhole end 101 of the sealing element 100 may radially expand the sealing element 100 into sealing engagement with a downhole surface. For example, a tapered surface of the expansion ring 190 may engage with a tapered surface of the inner bore 105 of the sealing element 100.

Figure 11:
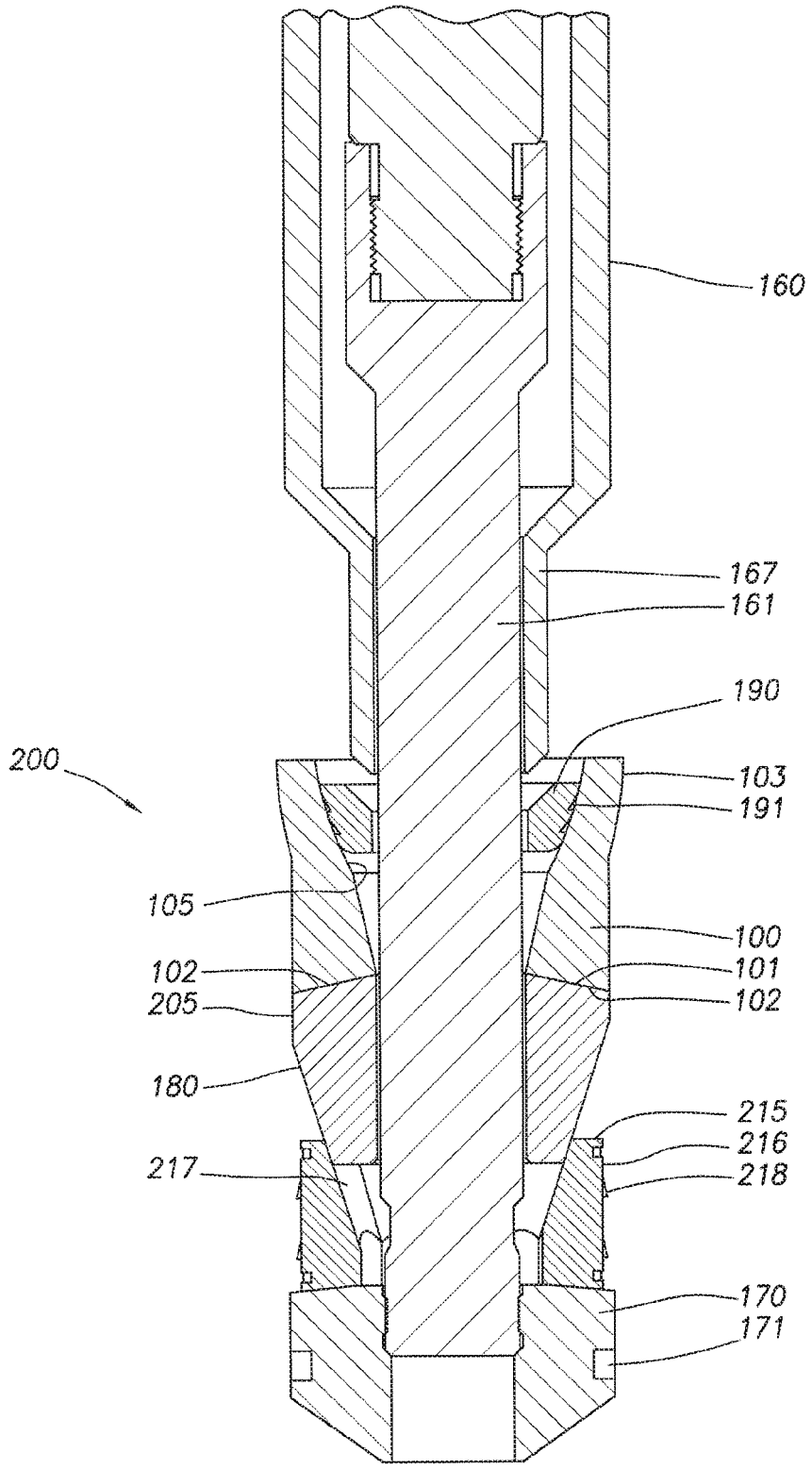
FIG. 11 is a cross-sectional view of a zonal isolation device having a pump-down ring engaged with a setting tool according to certain embodiments of the present disclosure.

In certain embodiments, the zonal isolation device 200 may be made up in the form depicted in FIG. 9, where the expansion ring 190 is disposed within the sealing element 100 but the sealing element 100 is not significantly expanded. In some embodiments, the zonal isolation device 200 may be run in the wellbore 120 in this configuration. As depicted in FIG. 11, the zonal isolation device 200 may be run in the wellbore 120 in a configuration where the expansion ring 190 is disposed within the sealing element 100 such that at least a portion of the sealing element 100 is at least partially expanded. In some embodiments, a partially expanded sealing element 100 may improve pump down efficiency.

In certain embodiments, the mandrel 161 may be shearably coupled to one or more components of the zonal isolation device 200 by one or more shear devices, including, but not limited to shear threads, shear pins, a shear ring, shear screws, shearable ridges, and the like, or any other shearable device. In embodiments where the mandrel 161 is shearably coupled to one or more components of the zonal isolation device 200, the mandrel 161 may overcome a shear force provided by the shear device. For example, during or after setting, enough upward force may be applied to the mandrel 161 to shear one or more shear devices and decouple the mandrel from one or more components of the zonal isolation device 200. In some embodiments, the mandrel 161 may be shearably coupled to the end element 170 by a shear device. In some embodiments, the shear force necessary to overcome one or more shear devices of the zonal isolation device 200 is from about 10,000 $lb_f$ to 50,000 $lb_f$.

As discussed above, the end element 170 may be coupled or uncoupled to the anchoring assembly 215. As depicted in FIG. 7, in embodiments where the end element 170 is not coupled to the anchoring assembly 215, the end element 170 may fall downhole and away from the zonal isolation device 200 after the mandrel 161 is actuated and decouples from the end element 170. In other embodiments where the end element 170 is coupled to the anchoring assembly 215, the end element 170 may be retained as part of the zonal isolation device after the setting tool 160 and mandrel 161 are removed. After setting the zonal isolation device 200, the setting tool 160 and mandrel 161 may be removed from the zonal isolation device 200 and the wellbore 120.

Figure 13:
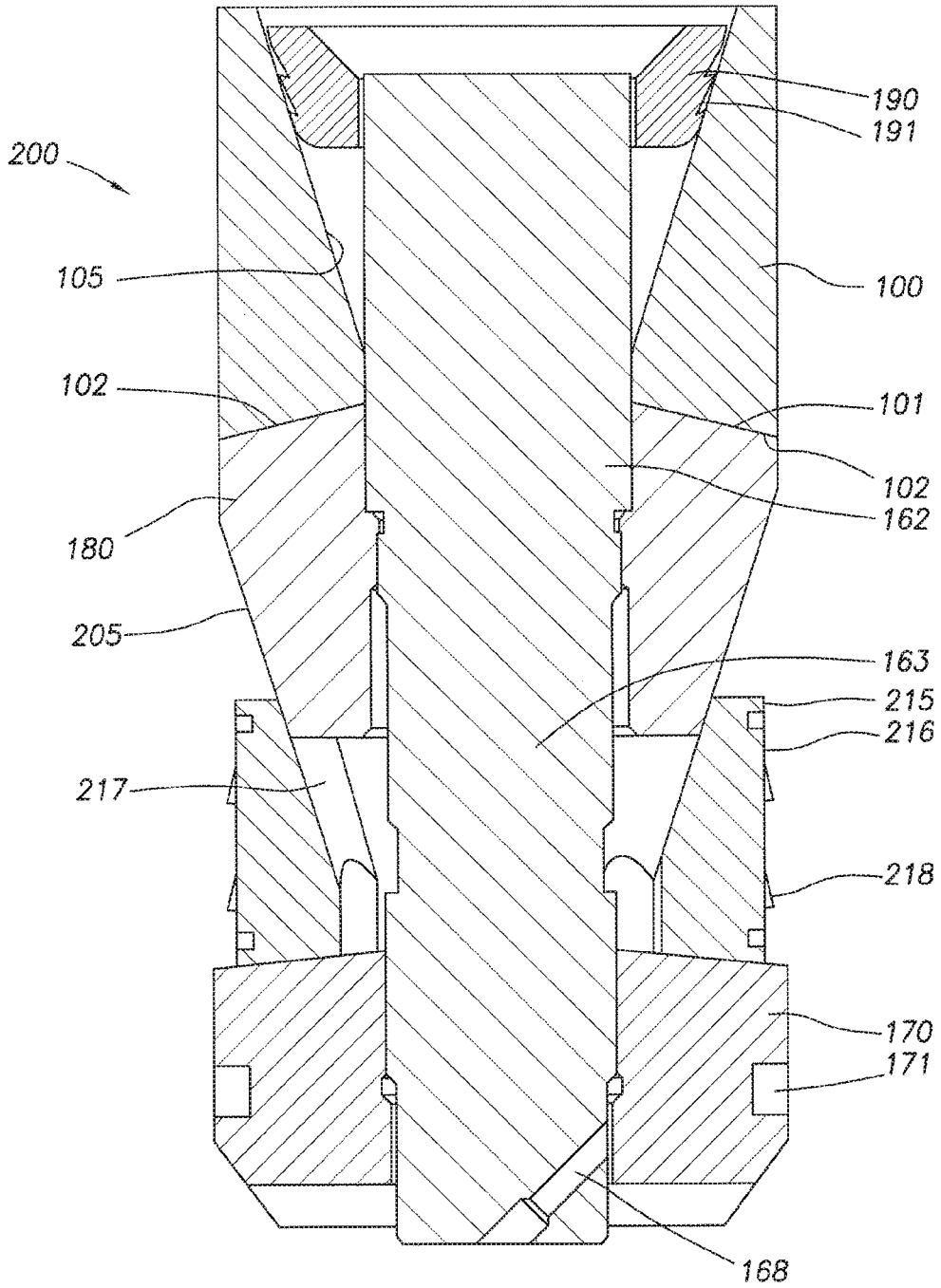
FIG. 13 is a cross-sectional view of a set zonal isolation device including a lower mandrel according to certain embodiments of the present disclosure.

In some embodiments, the zonal isolation device 200 may be run into a wellbore 120 via conveyance 140 in a sealed configuration. For example, as depicted in FIG. 13, the zonal isolation device may be run into the wellbore 120 with a lower mandrel 163 in the fluid communication pathway 206 of the zonal isolation device 200. The lower mandrel 163 may be disposed within the zonal isolation device 200 along a longitudinal axis. In certain embodiments, the lower mandrel 163 may be coupled to at least one of the end element 170, the anchoring assembly 215, the wedge 180 or the sealing element 100. The lower mandrel 163 may seal off the fluid communication pathway 206 formed along a longitudinal axis of the zonal isolation device 200, allowing completion or stimulation operations to take place without the use of a frac ball or other additional sealing device. The lower mandrel 163 may be coupled to a setting tool 160 while the zonal isolation device 200 is run into the wellbore 120. After setting, the setting tool, another mandrel (not shown), or the adapter kit 160 may be decoupled from the lower mandrel 163, leaving the lower mandrel 163 in place such that the zonal isolation device 200 is in a sealed configuration.

Figure 12:
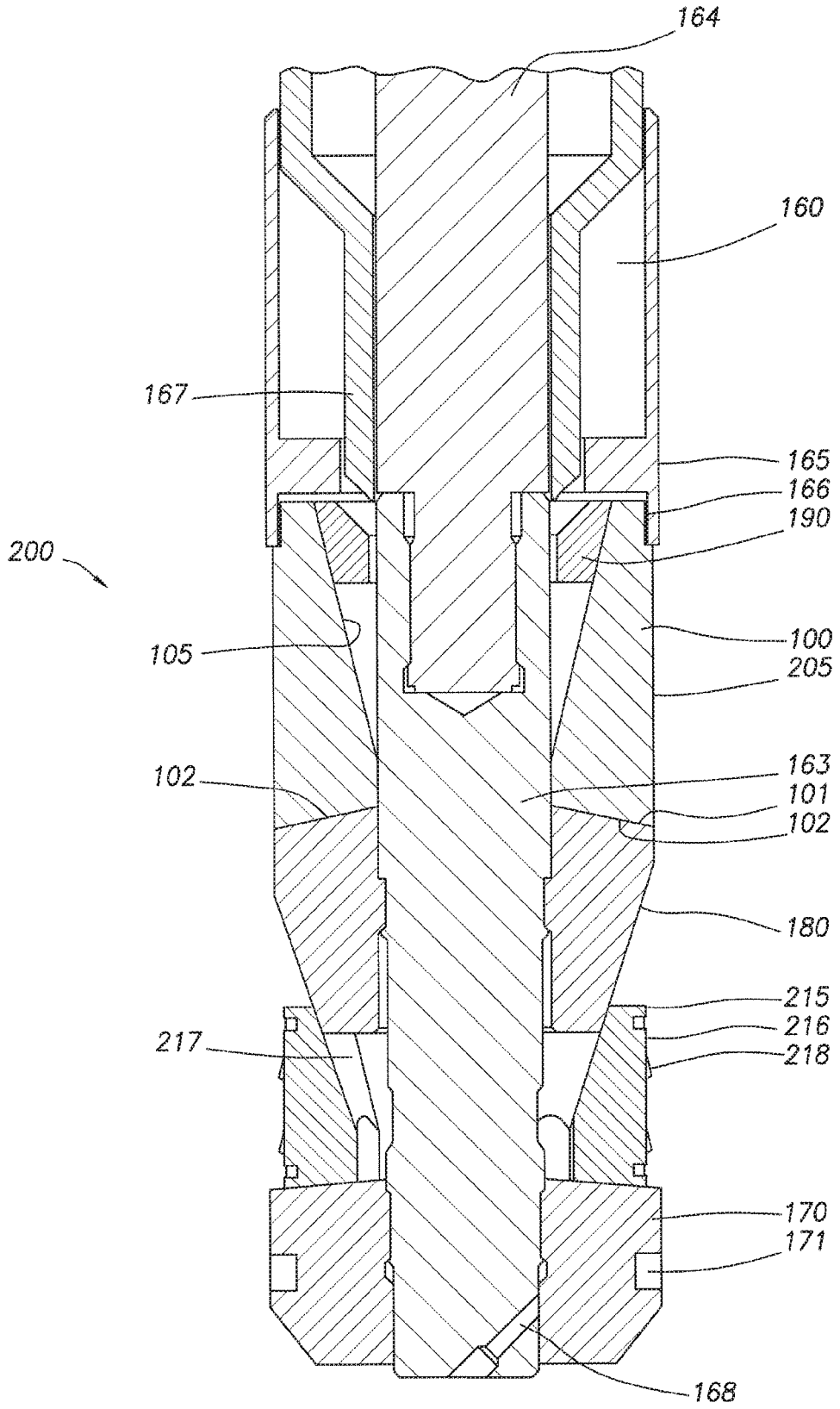
FIG. 12 is a cross-sectional view of a zonal isolation device engaged with a setting tool having an upper and lower mandrel according to certain embodiments of the present disclosure.

FIG. 13 depicts a zonal isolation device 200 in a set configuration. Before setting, the lower mandrel 163 may extend from the end element 170 to the anchoring assembly 215. During setting of the zonal isolation device 200, the lower mandrel 163 may move upwards into the wedge 180 before decoupling from the setting tool adapter kit 160 or other component. In some embodiments, the lower mandrel 163 may include a sealing surface 162 that seals the fluid communication pathway 206 of the zonal isolation device 200. The sealing surface 162 may include a larger diameter than at least one other portion of the lower mandrel 163 and may effectively prevent fluid flow around the lower mandrel 163. The lower mandrel 163 may comprise a dissolvable or degradable material. In some embodiments, as depicted in FIGS. 12 and 13, the lower mandrel 163 may comprise a set screw 168 that may couple the lower mandrel 163 to the end element 170. In some embodiments, the set screw 168 retains the lower mandrel 163 in the end element 170 and prevents it from decoupling from the end element 170.

As shown in FIG. 12, a lower mandrel 163 may be coupled to a setting tool 160 including an upper mandrel 164. The lower mandrel 163 may be detachably or shearably coupled to the upper mandrel 164, for example, by one or more shearable devices. Also depicted in FIG. 12 is a setting tool 160 comprising a protective sleeve 165. The protective sleeve 165 may include a flange or extended rim of the setting tool 160. The protective sleeve 165 may engage with an uphole end of a sealing element 100. For example, as depicted in FIG. 12, the sealing element 100 may engage an inner surface 166 of the protective sleeve 165. In certain embodiments, at least a portion of the sealing element 100 may have a diameter smaller than the diameter of the inner surface 166 of the protective sleeve 165. This configuration may improve pumping efficiency as the zonal isolation device 200 is pumped or run into the wellbore 120. In certain embodiments, this configuration may reduce the chance of a "preset," where the zonal isolation device 200 sets prior to reaching the target location.

For example, in certain embodiments, one or more components of the zonal isolation device 200 may include a pump-down ring. A pump-down ring may, in certain embodiments, be a portion of a component of the zonal isolation device 200 or the setting tool adapter kit 160 with an increased outer diameter relative to at least one other portion of the component. For example, as depicted in FIG. 11, the sealing element 100 may include a pump-down ring portion 103 having an increased outer diameter relative to the rest of the sealing element 100. In certain embodiments, pump-down rings may increase pump down efficiency for the zonal isolation device 200.

Figure 14:
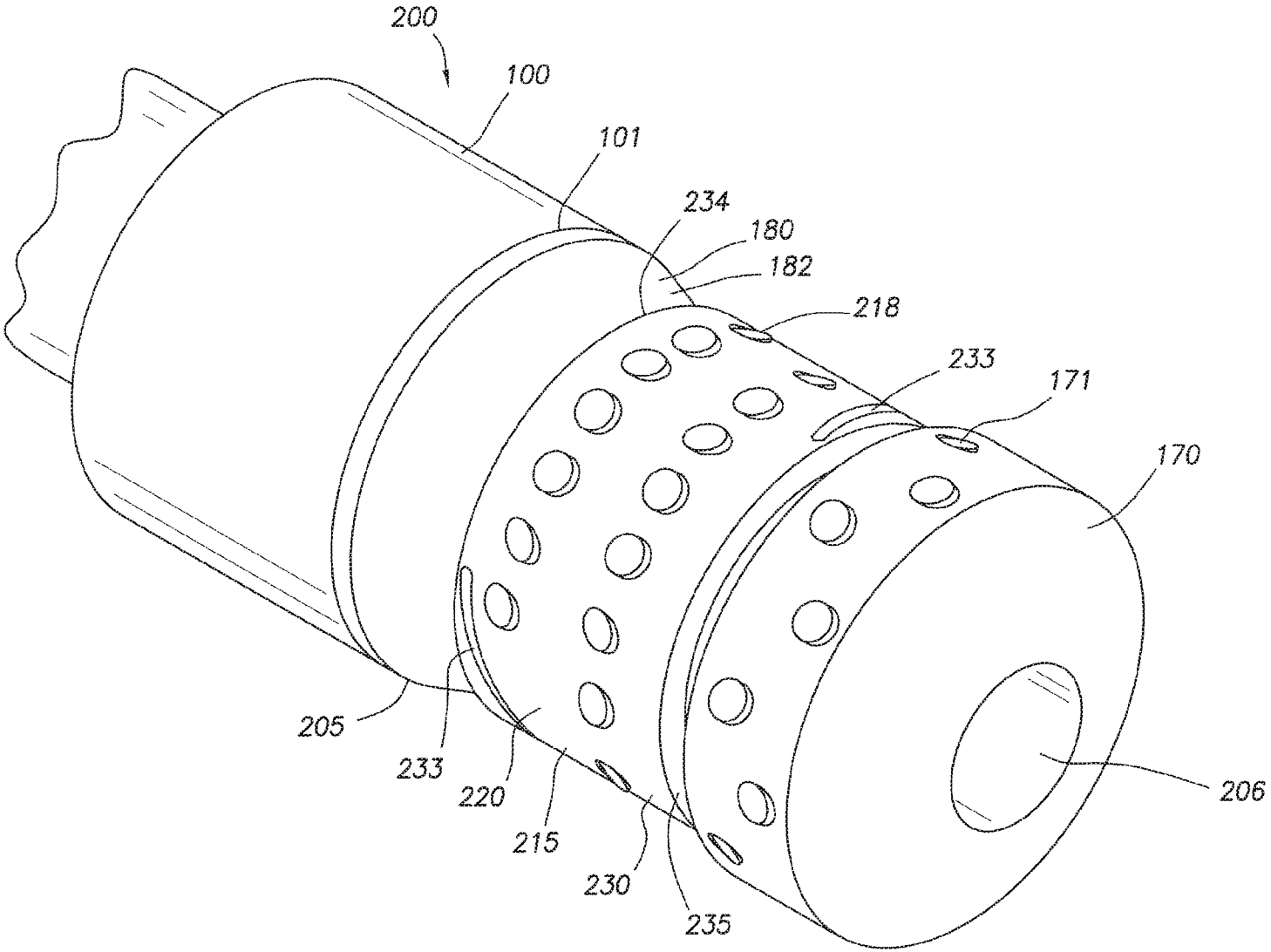
FIG. 14 is a perspective view of a zonal isolation device including an expandable collar according to certain embodiments of the present disclosure.
Figure 15:
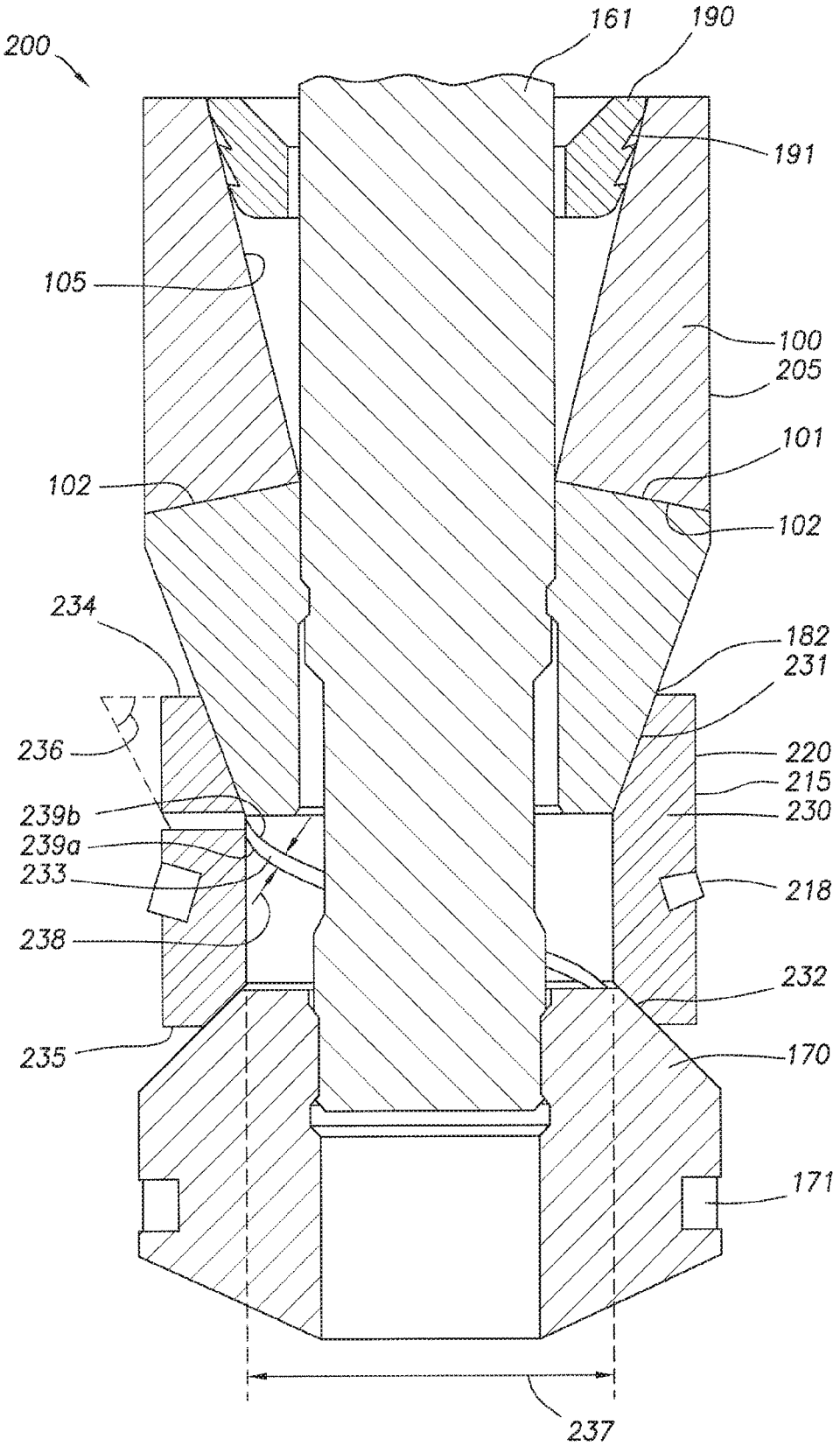
FIG. 15 is a cross-sectional view of a zonal isolation device including an expandable collar according to certain embodiments of the present disclosure.

With reference to FIGS. 14 and 15 the anchoring assembly 215 may include a one-piece expandable collar 220 with one or more scarf cuts 233 that allow the expandable collar 220 to radially expand as it moves with respect to the wedge 180, the end element 170, or both. In such embodiments the expandable collar 220 may include a generally annular body 230, an upper tapered surface 231 and a lower tapered surface 232. The upper tapered surface 231 may be configured to engage with and receive the wedge 180, depicted with a single frustoconical surface 182. The lower tapered surface 232 may, in certain embodiments, be configured to engage with and receive the end element 170. One or more scarf cuts 233 may be defined in the body 230 and extend at least partially between a first end 234 and a second end 235 of the expandable collar 220. A scarf cut 233 is generally a spiral or helically extending cut slot in the body 230. In certain embodiments, a scarf cut 233 may extend at least partially around the body 230 or around the circumference of body 230 more than once. A scarf cut 233 may be created by a variety of methods, including electrical discharge machining (EDM), sawing, milling, turning, or by any other machining techniques that result in the formation of a slit through the annular body 230. Although depicted in FIGS. 14 and 15 as having one scarf cut 233, the zonal isolation device may comprise two or more scarf cuts 233.

One or more scarf cuts 233 may extend between the first end 234 and second end 235 at an angle 236 relative to one of the first end 234 and the second end 235 or any other suitable plane extending normal to a longitudinal axis of the expandable collar 220. In the illustrated embodiment in FIGS. 14 and 15, the angle 236 of the one or more scarf cuts 233 is defined in the annular body 230 relative to the first end 234. In some embodiments, the angle 236 of the one or more scarf cuts 233 may be about 10°, about 15°, about 20°, about 40°, about 45°, or about 50°. In some embodiments, the angle 236 of the one or more scarf cuts 233 may range from about 0° to about 45°. In some embodiments, the angle 236 of the one or more scarf cuts 233 may range from about 5° to about 30°. As the angle 236 of the one or more scarf cuts 233 decreases, a circumferential length of the one or more scarf cuts 233 correspondingly increases. A greater circumferential length of the one or more scarf cuts 233 may, in certain embodiments, provide a larger expansion potential of the expandable collar 220 without the expandable collar 220 completely separating when viewed from an axial perspective.

The one or more scarf cuts 233 may permit diametrical expansion of the expandable collar 220 to an expanded state and into locking engagement with a downhole surface. In certain embodiments, due to the construction of the expandable collar 220, a large flow area can be provided through an inner diameter 237 of the body 230. During expansion of the expandable collar 220, the expandable collar 220 may radially expand into locking engagement with a downhole surface (e.g., with a casing). In the expanded state, a gap 238 may be formed between opposing angled surfaces 239*a,b* of the scarf cut 233. The angle 236 of the scarf cut 233 may be calculated such that when the expandable collar 220 moves to the expanded state, the opposing angled surfaces 239*a,b* of the scarf cut 233 axially overlap to at least a small degree such that no axial gaps are created in the body 230. Accordingly, the one or more scarf cuts 233 may enable the expandable collar 220 to separate at the opposing angled surfaces 239*a,b* and thereby enable a degree of freedom that permits expansion and contraction of the expandable collar 220 during operation. In certain embodiments, the first end 234 is movable relative to the second end 235 as the expandable collar 220 expands. In certain embodiments, the first end portion 234 rotates or otherwise moves circumferentially relative to the second end 235 during expansion. In certain embodiments, the first end 234 converges and/or diverges circumferentially relative to the second end 235 during expansion.

One or more components of the zonal isolation device 200 such as the wedge 180, expansion ring 190, anchoring assembly 215, end element 170, and/or lower mandrel 163 may comprise a variety of materials including, but not limited to, a metal, a polymer, a composite material, and any combination thereof. Suitable metals that may be used include, but are not limited to, steel, brass, aluminum, magnesium, iron, cast iron, tungsten, tin, and any alloys thereof. Suitable composite materials that may be used include, but are not limited to, materials including fibers (chopped, woven, etc.) dispersed in a phenolic resin, such as fiberglass and carbon fiber materials.

In some embodiments, one or more components of the zonal isolation device 200 such as the sealing element 100, wedge 180, expansion ring 190, anchoring assembly 215, end element 170, or lower mandrel 163 may be made of a degradable or dissolvable material. The degradable materials described herein may allow for time between setting a downhole tool (e.g., a zonal isolation device) and when a particular downhole operation is undertaken, such as a hydraulic fracturing treatment operation. In certain embodiments, degradable metal materials may allow for acid treatments and acidified stimulation of a wellbore. In some embodiments, the degradable metal materials may require a large flow area or flow capacity to enable production operations without unreasonably impeding or obstructing fluid flow while the zonal isolation device 200 degrades. As a result, production operations may be efficiently undertaken while the zonal isolation device 200 degrades and without creating significant pressure restrictions.

Degradable materials suitable for certain embodiments of the present disclosure include, but are not limited to borate glass, an aliphatic polyester, polyglycolic acid (PGA), polylactic acid (PLA), polyvinyl alcohol (PVA), a degradable rubber, a degradable polymer, a galvanically-corrodible metal, a dissolvable metal, a dehydrated salt, and any combination thereof. The degradable materials may be configured to degrade by a number of mechanisms including, but not limited to, swelling, dissolving, undergoing a chemical change, electrochemical reactions, undergoing thermal degradation, or any combination of the foregoing.

Degradation by swelling may involve the absorption by the degradable material of aqueous fluids or hydrocarbon fluids present within the wellbore environment such that the mechanical properties of the degradable material degrade or fail. Hydrocarbon fluids that may swell and degrade the degradable material include, but are not limited to, crude oil, a fractional distillate of crude oil, a saturated hydrocarbon, an unsaturated hydrocarbon, a branched hydrocarbon, a cyclic hydrocarbon, and any combination thereof. Exemplary aqueous fluids that may swell to degrade the degradable material include, but are not limited to, fresh water, saltwater (e.g., water containing one or more salts dissolved therein), brine (e.g., saturated salt water), seawater, acid, bases, or combinations thereof. In degradation by swelling, the degradable material may continue to absorb the aqueous and/or hydrocarbon fluid until its mechanical properties are no longer capable of maintaining the integrity of the degradable material and it at least partially falls apart. In some embodiments, the degradable material may be designed to only partially degrade by swelling in order to ensure that the mechanical properties of a component of the zonal isolation device 200 formed from the degradable material is sufficiently capable of lasting for the duration of the specific operation in which it is utilized.

Degradation by dissolving may involve a degradable material that is soluble or otherwise susceptible to an aqueous fluid or a hydrocarbon fluid, such that the aqueous or hydrocarbon fluid is not necessarily incorporated into the degradable material (as is the case with degradation by swelling), but becomes soluble upon contact with the aqueous or hydrocarbon fluid. Degradation by undergoing a chemical change may involve breaking the bonds of the backbone of the degradable material (e.g., a polymer backbone) or causing the bonds of the degradable material to crosslink, such that the degradable material becomes brittle and breaks into small pieces upon contact with even small forces expected in the wellbore environment. Thermal degradation of the degradable material may involve a chemical decomposition due to heat, such as the heat present in a wellbore environment. Thermal degradation of some degradable materials mentioned or contemplated herein may occur at wellbore environment temperatures that exceed about 93° C. (or about 200° F.).

With respect to degradable polymers used as a degradable material, a polymer may be considered "degradable" if the degradation is due to, in situ, a chemical and/or radical process such as hydrolysis, oxidation, or UV radiation. Degradable polymers, which may be either natural or synthetic polymers, include, but are not limited to, polyacrylics, polyamides, and polyolefins such as polyethylene, polypropylene, polyisobutylene, and polystyrene. Suitable examples of degradable polymers that may be used in accordance with the embodiments include polysaccharides such as dextran or cellulose, chitins, chitosans, proteins, aliphatic polyesters, poly(lactides), poly(glycolides), poly(ε-caprolactones), poly (hydroxybutyrates), poly(anhydrides), aliphatic or aromatic polycarbonates, poly(orthoesters), poly(amino acids), poly (ethylene oxides), polyphosphazenes, poly(phenyllactides), polyepichlorohydrins, copolymers of ethylene oxide/polyepichlorohydrin, terpolymers of epichlorohydrin/ethylene oxide/allyl glycidyl ether, and any combination thereof. In certain embodiments, the degradable material is polyglycolic acid or polylactic acid. In some embodiments, the degradable material is a polyanhydride. Polyanhydride hydrolysis may proceeds, in situ, via free carboxylic acid chain-ends to yield carboxylic acids as final degradation products. The erosion time may be varied over a broad range of changes in the polymer backbone. Examples of polyanhydrides suitable for certain embodiments of the present disclosure include, but are not limited to poly(adipic anhydride), poly(suberic anhydride), poly(sebacic anhydride), and poly(dodecanedioic anhydride). Other examples suitable for certain embodiments of the present disclosure include, but are not limited to poly(maleic anhydride) and poly(benzoic anhydride).

Degradable rubbers suitable for certain embodiments of the present disclosure include, but are not limited to degradable natural rubbers (i.e., cis-1,4-polyisoprene) and degradable synthetic rubbers, which may include, but are not limited to, ethylene propylene diene M-class rubber, isoprene rubber, isobutylene rubber, polyisobutene rubber, styrene-butadiene rubber, silicone rubber, ethylene propylene rubber, butyl rubber, norbornene rubber, polynorbornene rubber, a block polymer of styrene, a block polymer of styrene and butadiene, a block polymer of styrene and isoprene, and any combination thereof. Other degradable polymers suitable for certain embodiments of the present disclosure include those that have a melting point that is such that it will dissolve at the temperature of the subterranean formation in which it is placed.

In some embodiments, the degradable material may have a thermoplastic polymer embedded therein. The thermoplastic polymer may modify the strength, resiliency, or modulus of a portion of the zonal isolation device 200 and may also control the degradation rate. Thermoplastic polymers suitable for certain embodiments of the present disclosure include, but are not limited to an acrylate (e.g., polymethylmethacrylate, polyoxymethylene, a polyamide, a polyolefin, an aliphatic polyamide, polybutylene terephthalate, polyethylene terephthalate, polycarbonate, polyester, polyethylene, polyetheretherketone, polypropylene, polystyrene, polyvinylidene chloride, styrene-acrylonitrile), polyurethane prepolymer, polystyrene, poly(o-methylstyrene), poly (m-methylstyrene), poly(p-methylstyrene), poly(2,4-dimethylstyrene), poly(2,5-dimethylstyrene), poly(p-tert-butylstyrene), poly(p-chlorostyrene), poly(α-methylstyrene), co- and ter-polymers of polystyrene, acrylic resin, cellulosic resin, polyvinyl toluene, and any combination thereof. Each of the foregoing may further comprise acrylonitrile, vinyl toluene, or methyl methacrylate. The amount of thermoplastic polymer that may be embedded in a degradable material may be any amount that confers a desirable elasticity without affecting the desired amount of degradation. In some embodiments, the thermoplastic polymer may be included in an amount in the range of a lower limit of about 1%, 5%, 10%, 15%, 20%, 25%, 30%, 35%, 40%, and 45% to an upper limit of about 91%, 85%, 80%, 75%, 70%, 65%, 60%, 55%, 50%, and 45% by weight of the degradable material, encompassing any value or subset therebetween.

In certain embodiments, galvanically-corrodible metals may be used as a degradable material and may be configured to degrade via an electrochemical process in which the galvanically-corrodible metal corrodes in the presence of an electrolyte (e.g., brine or other salt-containing fluids present within the wellbore). Galvanically-corrodible metals suitable for certain embodiments of the present disclosure include, but are not limited to tin, aluminum, zinc, and magnesium. Galvanically-corrodible metals may include a nano-structured matrix. One example of a nano-structured matrix micro-galvanic material is a magnesium alloy with iron-coated inclusions. Galvanically-corrodible metals suitable for certain embodiments of the present disclosure include micro-galvanic metals or materials, such as a solution-structured galvanic material. An example of a solution-structured galvanic material is zirconium (Zr) containing a magnesium (Mg) alloy, where different domains within the alloy contain different percentages of Zr. This may lead to a galvanic coupling between these different domains, which causes micro-galvanic corrosion and degradation. Micro-galvanically corrodible magnesium alloys could also be solution-structured with other elements such as zinc, aluminum, nickel, iron, carbon, tin, silver, copper, titanium, rare earth elements, et cetera. Micro-galvanically corrodible aluminum alloys could be in solution with elements such as nickel, iron, carbon, tin, silver, copper, titanium, gallium, et cetera.

In some embodiments, blends of certain degradable materials may also be suitable as the degradable material for at least a portion of the zonal isolation device 200. One example of a suitable blend of degradable materials is a mixture of PLA and sodium borate. Another example may include a blend of PLA and boric oxide. The choice of blended degradable materials may depend, at least in part, on the conditions of the well (e.g., wellbore temperature). For instance, lactides have been found to be suitable for lower temperature wells, including those within the range of 60° F. to 150° F., and PLAs have been found to be suitable for wellbore temperatures above this range. In addition, PLA may be suitable for higher temperature wells. Some stereoisomers of poly(lactide) or mixtures of such stereoisomers may be suitable for even higher temperature applications. Dehydrated salts may also be suitable for higher temperature wells. Other blends of degradable materials may include materials that include different alloys including using the same elements but in different ratios or with a different arrangement of the same elements.

In some embodiments, a degradable material may include a material that has undergone different heat treatments and exhibits varying grain structures or precipitation structures. As an example, in some magnesium alloys, the beta phase can cause accelerated corrosion if it occurs in isolated particles. Homogenization annealing for various times and temperatures causes the beta phase to occur in isolated particles or in a continuous network. In this way, the corrosion behavior may be different for the same alloy with different heat treatments.

In some embodiments, all or a portion of the outer surface of at least a portion of the zonal isolation device 200 may be treated to impede degradation. For example, a surface of the zonal isolation device 200 may undergo a treatment that aids in preventing the degradable material (e.g., a galvanically-corrodible metal) from galvanically-corroding. Treatments suitable for certain embodiments of the present disclosure include, but are not limited to, an anodizing treatment, an oxidation treatment, a chromate conversion treatment, a dichromate treatment, a fluoride anodizing treatment, a hard anodizing treatment, and any combination thereof. Some anodizing treatments may result in an anodized layer of material being deposited on the surface. The anodized layer may comprise materials such as, but not limited to, ceramics, metals, polymers, epoxies, elastomers, or any combination thereof and may be applied using any suitable processes known to those of skill in the art. Examples of suitable processes that result in an anodized layer include, but are not limited to, soft anodize coating, anodized coating, electroless nickel plating, hard anodized coating, ceramic coatings, carbide beads coating, plastic coating, thermal spray coating, high velocity oxygen fuel (HVOF) coating, a nano HVOF coating, a metallic coating, and any combination thereof.

In some embodiments, all or a portion of an outer surface of the zonal isolation device 200 may be treated or coated with a substance configured to enhance degradation of the degradable material. For example, such a treatment or coating may be configured to remove a protective coating or treatment or otherwise accelerate the degradation of the degradable material of the zonal isolation device 200. In some embodiments, a galvanically-corroding metal material is coated with a layer of PGA. In this example, the PGA may undergo hydrolysis and cause the surrounding fluid to become more acidic, which may accelerate the degradation of the underlying metal.

In some embodiments, the degradable material may be made of dissimilar metals that generate a galvanic coupling that either accelerates or decelerates the degradation rate of the zonal isolation device 200. As will be appreciated, such embodiments may depend on where the dissimilar metals lie on the galvanic potential. In at least one embodiment, a galvanic coupling may be generated by embedding a cathodic substance or piece of material into an anodic structural element. For instance, the galvanic coupling may be generated by dissolving aluminum in gallium. A galvanic coupling may also be generated by using a sacrificial anode coupled to the degradable material. In such embodiments, the degradation rate of the degradable material may be decelerated until the sacrificial anode is dissolved or otherwise corroded away.

An embodiment of the present disclosure is a zonal isolation device, comprising: a tubular body having a fluid communication pathway formed along a longitudinal axis comprising: a sealing element comprising a deformable material and an inner bore forming at least a portion of the fluid communication pathway; an expansion ring disposed within the bore of the sealing element; a wedge engaged with a downhole end of the sealing element; and an anchoring assembly engaged with the wedge.

In one or more embodiments described in the preceding paragraph, the tubular body further comprises an end element adjacent the anchoring assembly. In one or more embodiments described above, the sealing element is radially expandable into sealing engagement with a downhole surface. In one or more embodiments described above, the anchoring assembly comprises a plurality of arcuate-shaped slip segments for locking engagement with a downhole surface. In one or more embodiments described above, at least two of the plurality of arcuate-shaped slip segments are interconnected by a shearable link. In one or more embodiments described above, the shearable link shears upon axial expansion. In one or more embodiments described above, longitudinal compression of the tubular body radially expands the sealing element and radially expands the anchoring assembly. In one or more embodiments described above, the sealing element is coupled to the wedge and the wedge is coupled to the anchoring assembly. In one or more embodiments described above, the wedge is coupled to the sealing element by a compression fit, an interference fit, or a bonding agent.

Another embodiment of the present disclosure is a method comprising: inserting into a wellbore a zonal isolation device disposed on a setting tool adapter kit comprising a mandrel, wherein the zonal isolation device comprises: a sealing element comprising a deformable material and an inner bore; an expansion ring movably disposed within the inner bore of the sealing element; a wedge engaged with a downhole end of the sealing element; an anchoring assembly engaged with the wedge; and an end element adjacent the anchoring assembly and detachably coupled to the mandrel; and actuating to pull upwardly on the mandrel, wherein the upward movement of the mandrel longitudinally compresses the zonal isolation device, causing the expansion ring to axially move relative to the sealing element and radially expand the sealing element into a sealing engagement with a downhole surface.

In one or more embodiments described in the preceding paragraph, the upward movement of the mandrel engages the anchoring assembly with the wedge, radially expanding the anchoring assembly into a locking engagement with the downhole surface. In one or more embodiments described above, the method further comprises shearing a shear device coupling the mandrel to the end element. In one or more embodiments described above, the method further comprises removing the setting tool adapter kit and the mandrel from the wellbore. In one or more embodiments described above, one or more components of the zonal isolation device comprises a pump-down ring. In one or more embodiments described above, the method further comprises seating a sealing ball on the expansion ring. In one or more embodiments described above, the anchoring assembly comprises a plurality of arcuate-shaped slip segments for locking engagement with the downhole surface. In one or more embodiments described above, upon sufficient movement of the wedge relative to the plurality of arcuate-shaped slip segments, at least two of the plurality of arcuate-shaped slip segments slip segments are separated from each other by shearing a shearable link joining the at least two slip segments.

Another embodiment of the present disclosure is a zonal isolation system, comprising: a setting tool adapter kit comprising a mandrel; a sealing element disposed on the mandrel for sealing engagement with a downhole surface; an expansion ring movably disposed on the mandrel and engaged with the sealing element; a wedge disposed on the mandrel; and an anchoring assembly disposed around the mandrel for locking engagement with a downhole surface.

In one or more embodiments described in the preceding paragraph, the system further comprises an end element coupled to the mandrel. In one or more embodiments described in the preceding sentence, the end element is detachably coupled to the mandrel by a shearing element.

Figure 16:
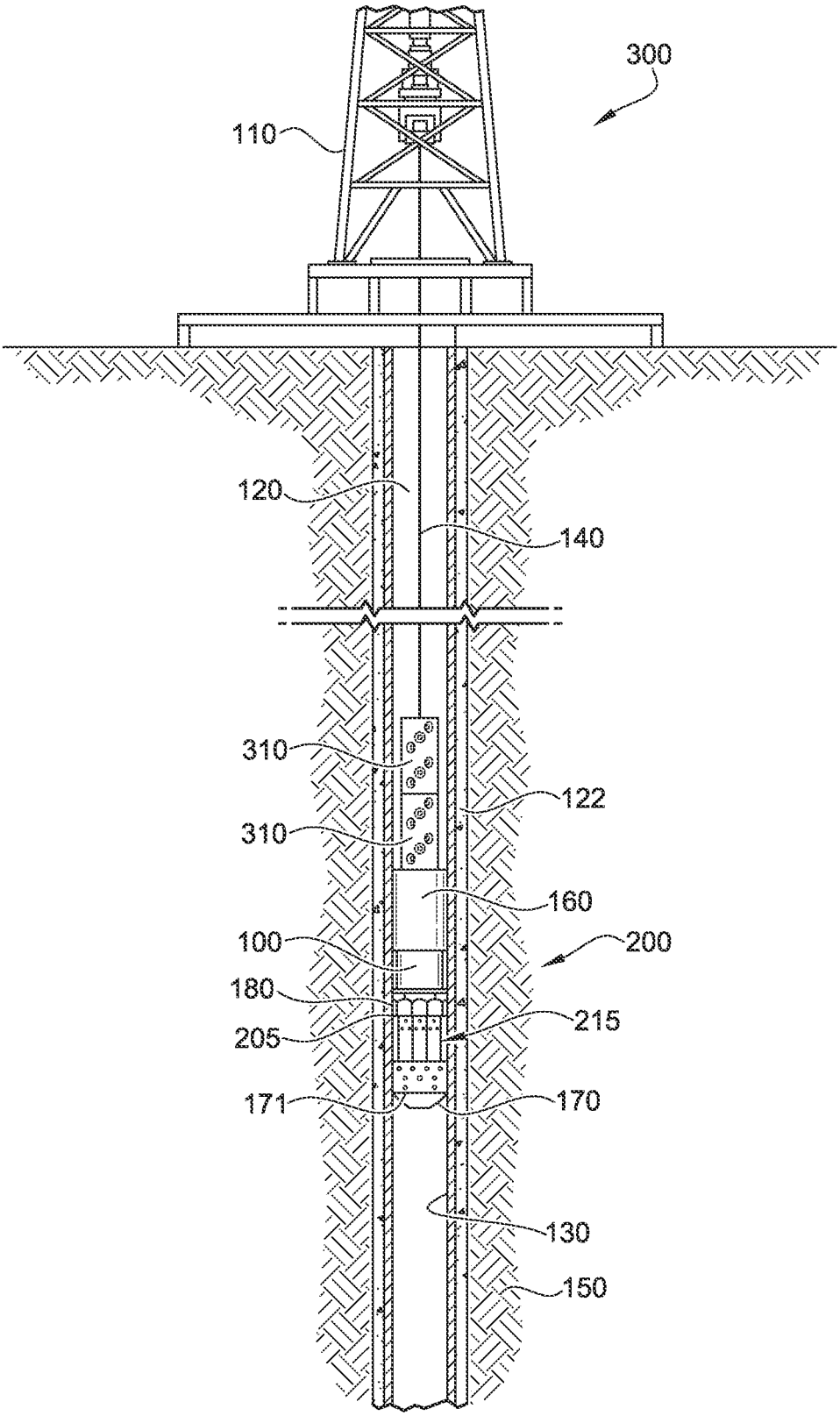
FIG. 16 is a diagram illustrating an environment for a zonal isolation device according to certain embodiments of the present disclosure.

Referring to FIG. 16, a zonal isolation device 200 is employed in a wellbore system 300 according to certain embodiments of the present disclosure. A wellbore system 300 for sealing a zonal isolation device in a wellbore includes a service rig 110 extending over and around a wellbore 120. The service rig 110 may comprise a drilling rig, a completion rig, a workover rig, or the like. In some embodiments, the service rig 110 may be omitted and replaced with a standard surface wellhead completion or installation, without departing from the scope of the disclosure. The wellbore 120 is within a subterranean formation 150 and has a casing 130 lining the wellbore 120, the casing 130 held into place by cement 122. In some embodiments, the wellbore casing 130 may be omitted from all or a portion of the wellbore 120 and the principles of the present disclosure may alternatively apply to an "open-hole" environment. Although shown as vertical, the wellbore 120 may include horizontal, vertical, slant, curved, and other types of wellbore 120 geometries and orientations. As depicted, the zonal isolation device 200 may include a tubular body 205 comprising a sealing element 100, a wedge 180, an anchoring assembly 215, and an end element 170 such as a mule shoe or the like. The zonal isolation device 200 may be coupled to a setting tool adapter kit 160 (also referred to as a setting tool assembly) for conveyance into the wellbore and setting. The setting tool adapter kit 160 may comprise a mandrel that may engage with the zonal isolation device 200. In embodiments, the setting tool adapter kit 160 may be coupled to one or more perforating guns 310 typically located uphole from the setting tool adapter kit 160. The zonal isolation device 200, the setting tool adapter kit 160, and the perforation guns 310 may be moved down the wellbore 120 via a conveyance 140 that extends from the service rig 110 to a target location. The conveyance 140 can be, for example, tubing-conveyed, wireline, slickline, work string, or any other suitable means for conveying zonal isolation devices into a wellbore. In certain embodiments, the conveyance 140 may be coupled to the perforating guns 310 that are coupled to the setting tool adapter kit 160 that is coupled to the zonal isolation device 200. As an alternative, in some embodiments, a conveyance 140 is not used and the entire zonal isolation device 200 is pumped to location as an untethered device. As depicted in FIG. 16, the setting tool is an internal setting tool, but an external setting tool could be used in one or more embodiments of the present disclosure. Examples of suitable setting tools for certain embodiments of the present disclosure include, but are not limited to Baker 10, Baker 20, 3½ HES GO, and the like, or any other suitable setting tool. In some embodiments, the zonal isolation device 200 may be pumped to the target location using hydraulic pressure applied from the service rig 110. For example in an embodiment as shown in FIG. 16, the conveyance 140 is a wireline that allows the zonal isolation device 200 and associated setting tool adapter kit 160 and perforating guns 310 to be pumped through the wellbore to a desired location (e.g., proximate a zone to be perforated and fractured). In such embodiments, the conveyance 140 serves to maintain control of the zonal isolation device 200 as it traverses the wellbore 120 and provides the necessary power to actuate and set the zonal isolation device 200 upon reaching the target location. In other embodiments, the zonal isolation device 200 freely falls to the target location under the force of gravity. Upon reaching the target location, the zonal isolation device 200 may be actuated or "set" and thereby provide a point of fluid isolation within the wellbore 120. Setting may occur by longitudinal compression of the tubular body 205, which may move the sealing element 100 into sealing engagement with one or more downhole surfaces, and may also move the anchoring assembly 215 into locking engagement with one or more downhole surfaces (e.g., an interior surface of casing 130). After setting, the setting tool adapter kit 160 may disengage from the zonal isolation device 200 and be withdrawn from the wellbore 120.

In FIG. 16, the zonal isolation device 200 is depicted in an unset configuration, and the perforating guns 310 have not fired. In the unset configuration, the anchoring assembly 215 is configured such that the zonal isolation device can be moved uphole or downhole without catching on the casing 130 of the wellbore 120. Once the zonal isolation device 200 reaches the desired location, the setting tool adapter kit 160 may be actuated (e.g, by the setting tool) to set the zonal isolation device 200, anchoring it into place and moving it into a sealing engagement. Then the perforating guns 310 may fire to create perforations in the casing and surrounding formation adjacent the wellbore wall. Prior to firing, the perforating guns 310 may be moved (e.g., uphole) a distance from the set zonal isolation device, if desired. It should be noted that while FIG. 16 generally depicts a land-based operation, the principles described herein are equally applicable to operations that employ floating or sea-based platforms and rigs, without departing from the scope of the disclosure. It should also be noted that a plurality of sets of perforating guns 310 and zonal isolation devices 200 may be placed in the wellbore 120. In some embodiments, for example, two or more sets of perforating guns 310 and zonal isolation devices 200 may be arranged in the wellbore 120 to divide the wellbore 120 into smaller intervals or "zones" for a particular operation (e.g., hydraulic stimulation).

Figure 17:
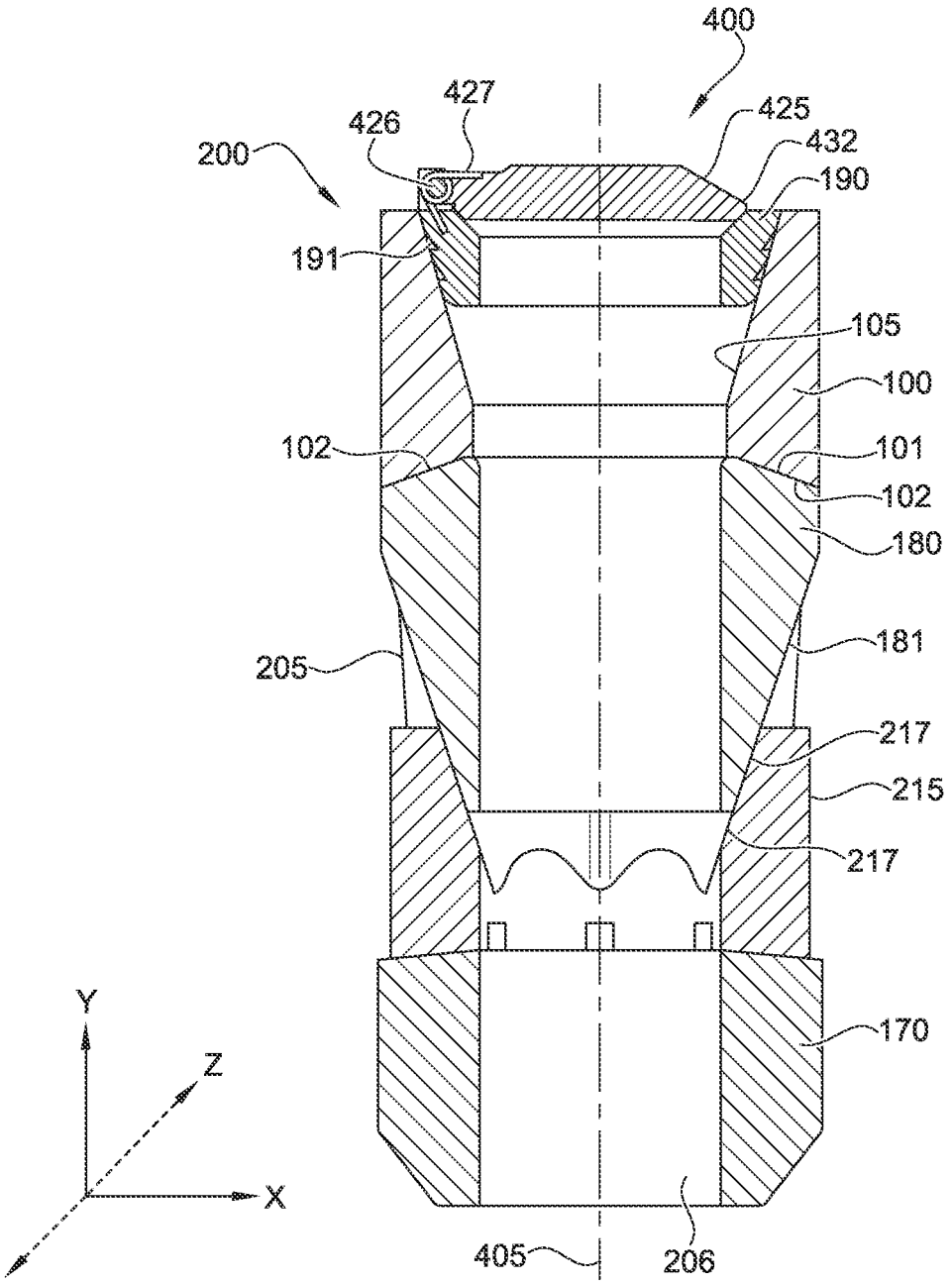
FIG. 17 is a cross-sectional view of a zonal isolation device with a rotatable sealing component according to certain embodiments of the present disclosure.

Referring to FIG. 17, an x-y-z coordinate system is illustrated, wherein a left side and a right side are along a first or x-axis, the central axis 405 of the zonal isolation device 200 is along a second or y-axis, wherein the y-axis is in the same plane as and perpendicular to the x-axis, and a front side and a back side are along a z-axis, wherein the z-axis is along a plane perpendicular to the plane of the x-axis and the y-axis. Unless otherwise indicated, the x-y-z coordinate system applies to FIGS. 17, 18A, 18B, 19, 20A, 20B, 21, and 22.

Figure 20A:
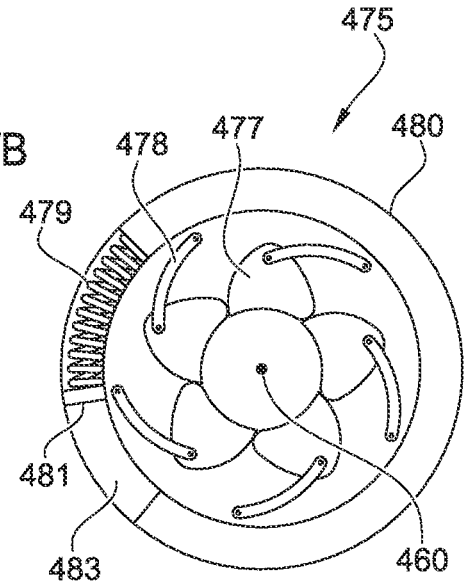
FIG. 20A is a top view of zonal isolation device of FIG. 19 with a rotatable sealing component in an open position according to certain embodiments of the present disclosure.
Figure 20B:
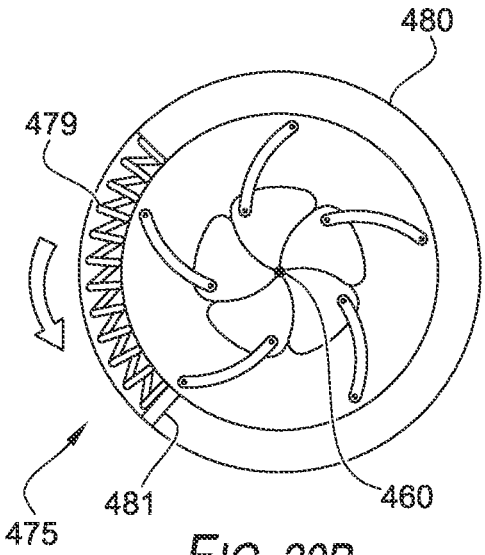
FIG. 20B is a top view of a zonal isolation device of FIG. 19 with a rotatable sealing component in a closed position according to certain embodiments of the present disclosure.
Figure 21:
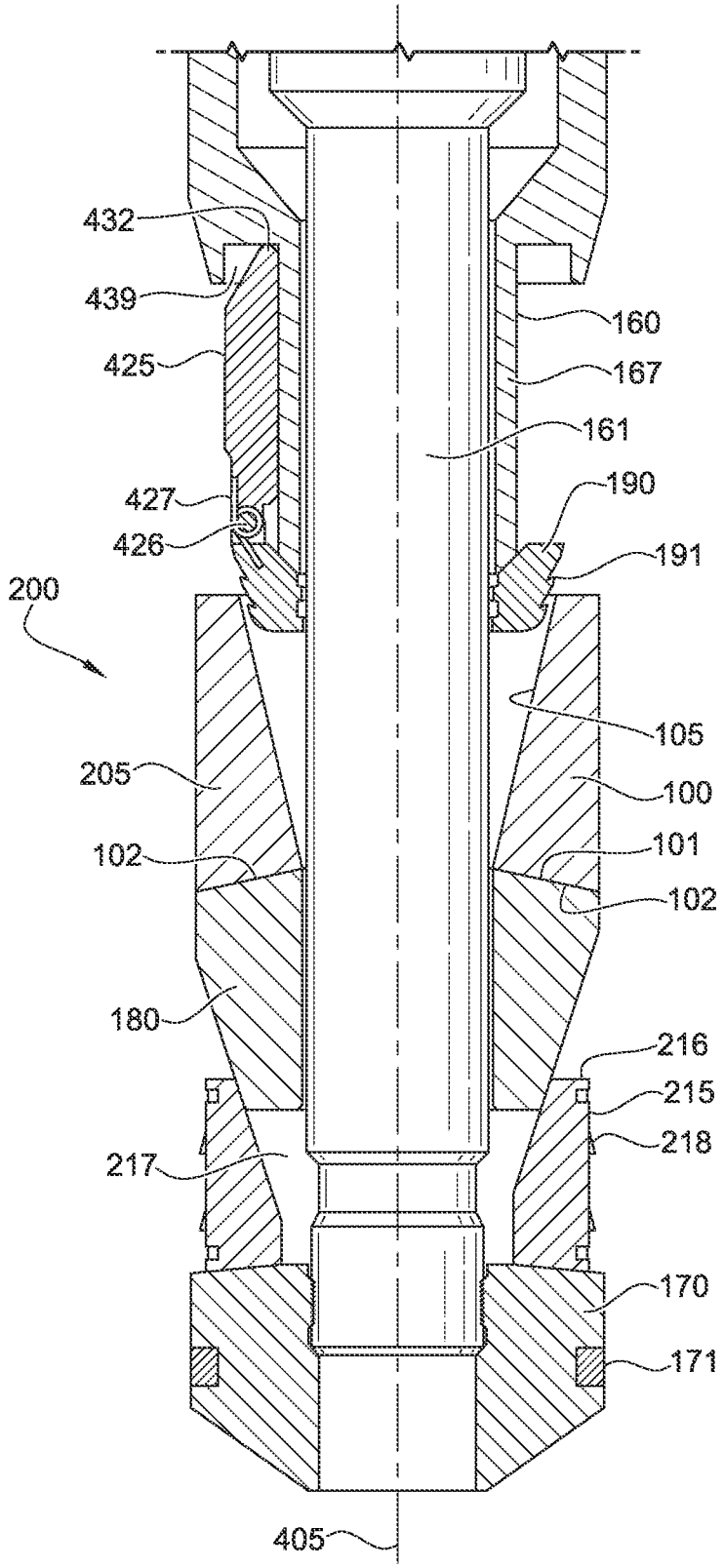
FIG. 21 is a cross-sectional view of a zonal isolation device with a rotatable sealing component and having a floating support ring engaged with a setting tool according to certain embodiments of the present disclosure.

In embodiments, as depicted in FIG. 17, the zonal isolation device 200 comprises: a sealing element 100 comprising a deformable material and an inner bore 105; a support ring 190 movably disposed within the inner bore 105 of the sealing element 100; a rotatable sealing component 400 directly or indirectly connected to the uphole end of the support ring 190, wherein the rotatable sealing component blocks fluid flow through the zonal isolation device 200 in a closed position and allows fluid flow through the zonal isolation device 200 in an open position and wherein a mandrel 161 of a setting tool is engaged with and holds the rotatable sealing component 400 in the open position while the zonal isolation device 200 is inserted into the wellbore as shown in FIG. 21; a wedge 180 engaged with a downhole end of the sealing element 100; an anchoring assembly 215 engaged with the wedge 180; and an end element 170 (e.g., a mule shoe) adjacent the anchoring assembly 215 and detachably coupled to the mandrel 161 of the setting tool. The support ring may also be referred to as a frustrum having a conical shape, and it should be noted that support ring 190 of FIGS. 16-22 is similar to expansion ring 190 of FIGS. 1-15, with the further understanding that support ring 190 further supports the rotatable sealing component 400 as described herein.

Figure 18A:
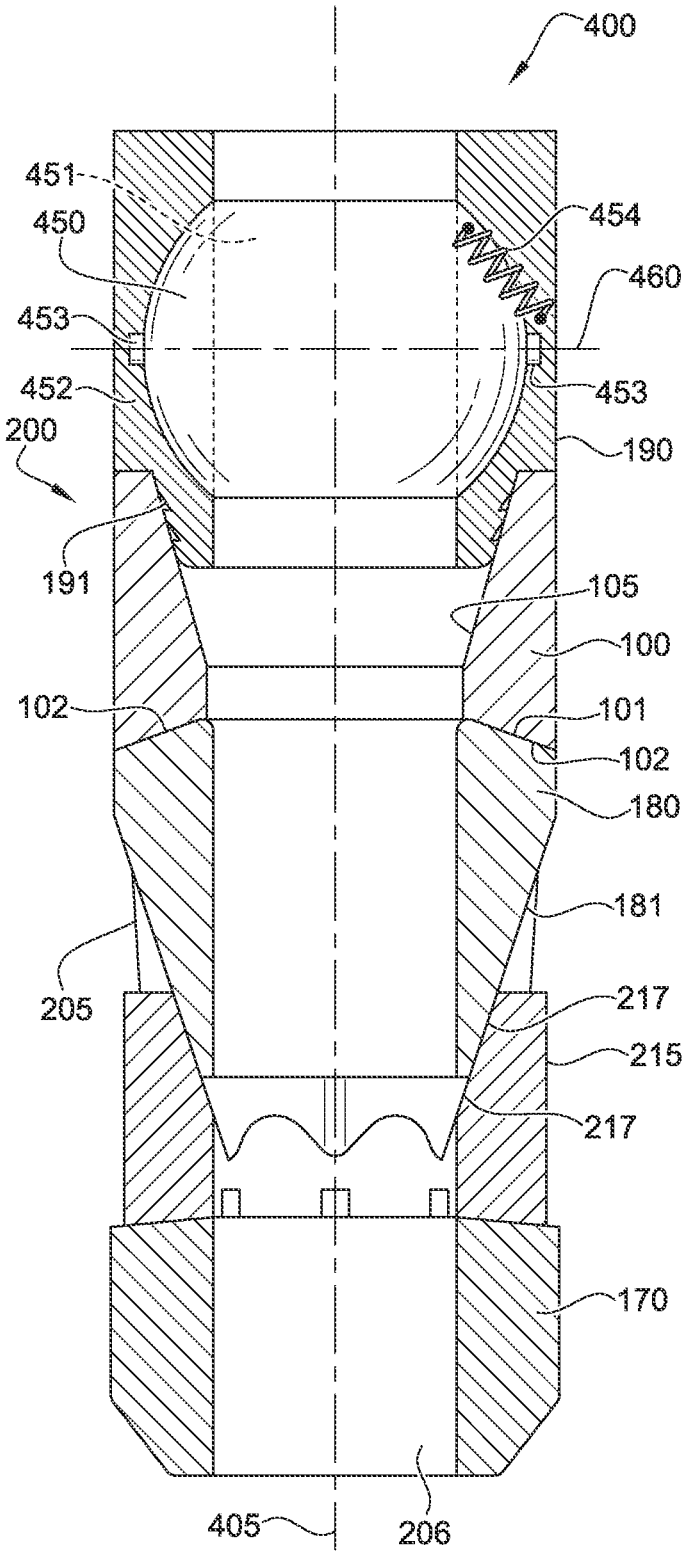
FIG. 18A is a cross-sectional view of a zonal isolation device with a rotatable sealing component in an open position according to certain embodiments of the present disclosure.
Figure 18B:
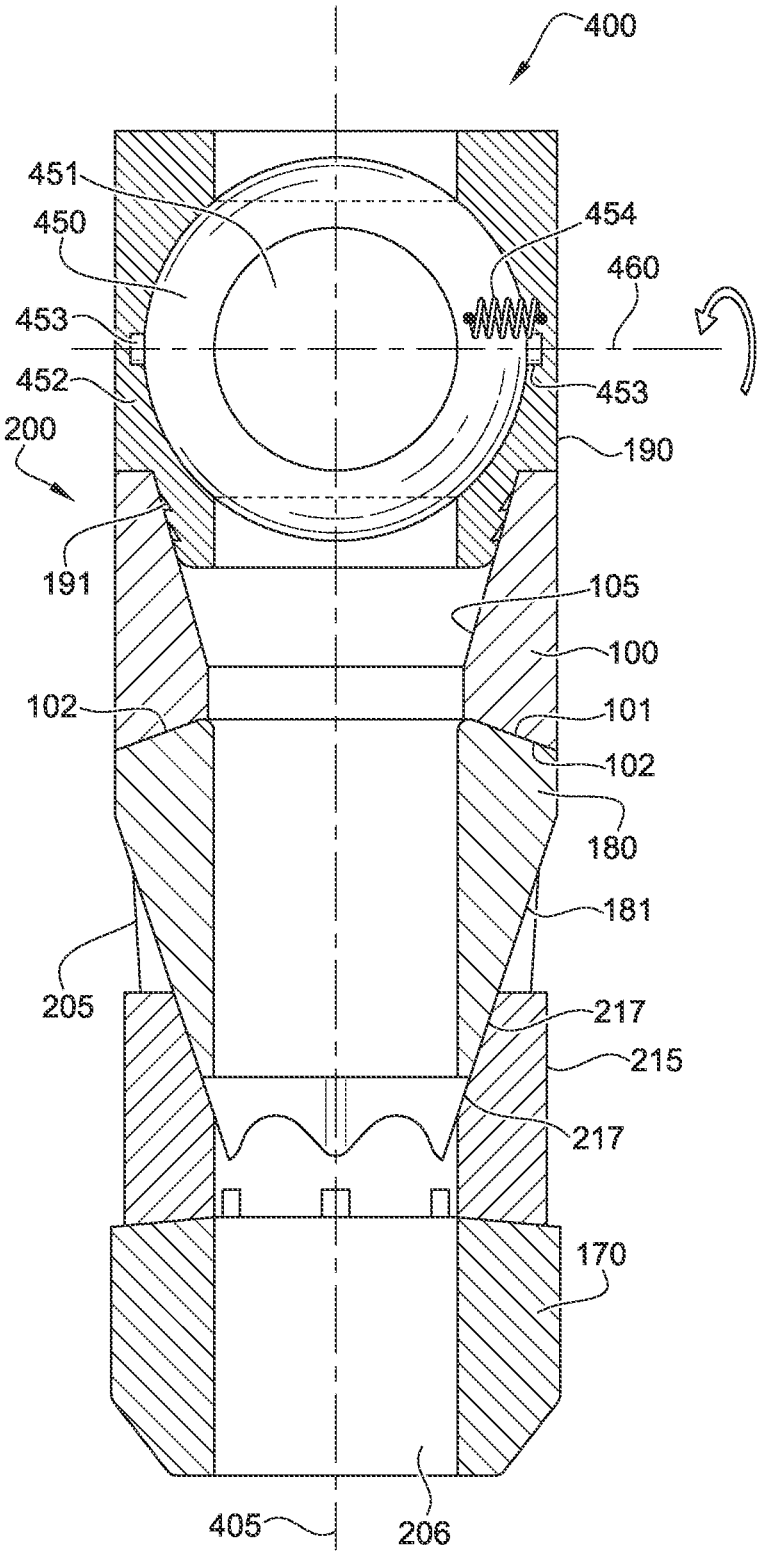
FIG. 18B is a cross-sectional view of a zonal isolation device with a rotatable sealing component in a closed position according to certain embodiments of the present disclosure.
Figure 19:
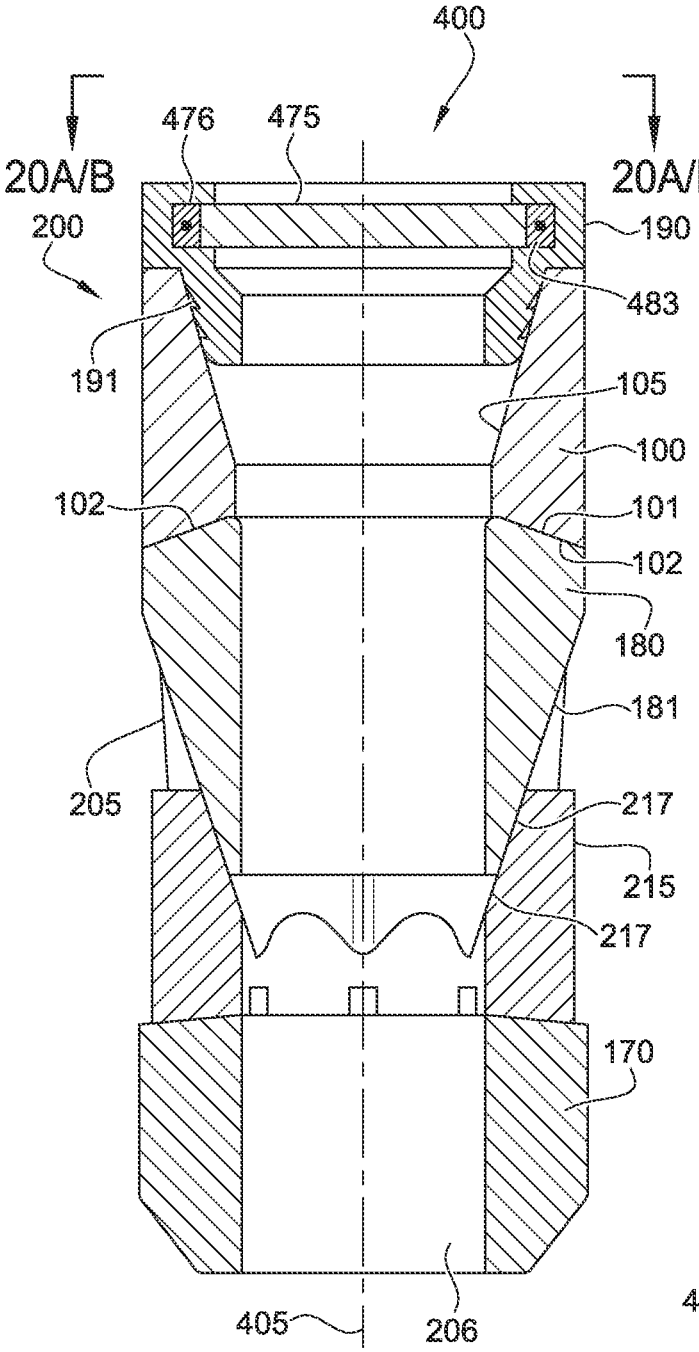
FIG. 19 is a cross-sectional view of a zonal isolation device with a rotatable sealing component according to certain embodiments of the present disclosure.
Figure 22:
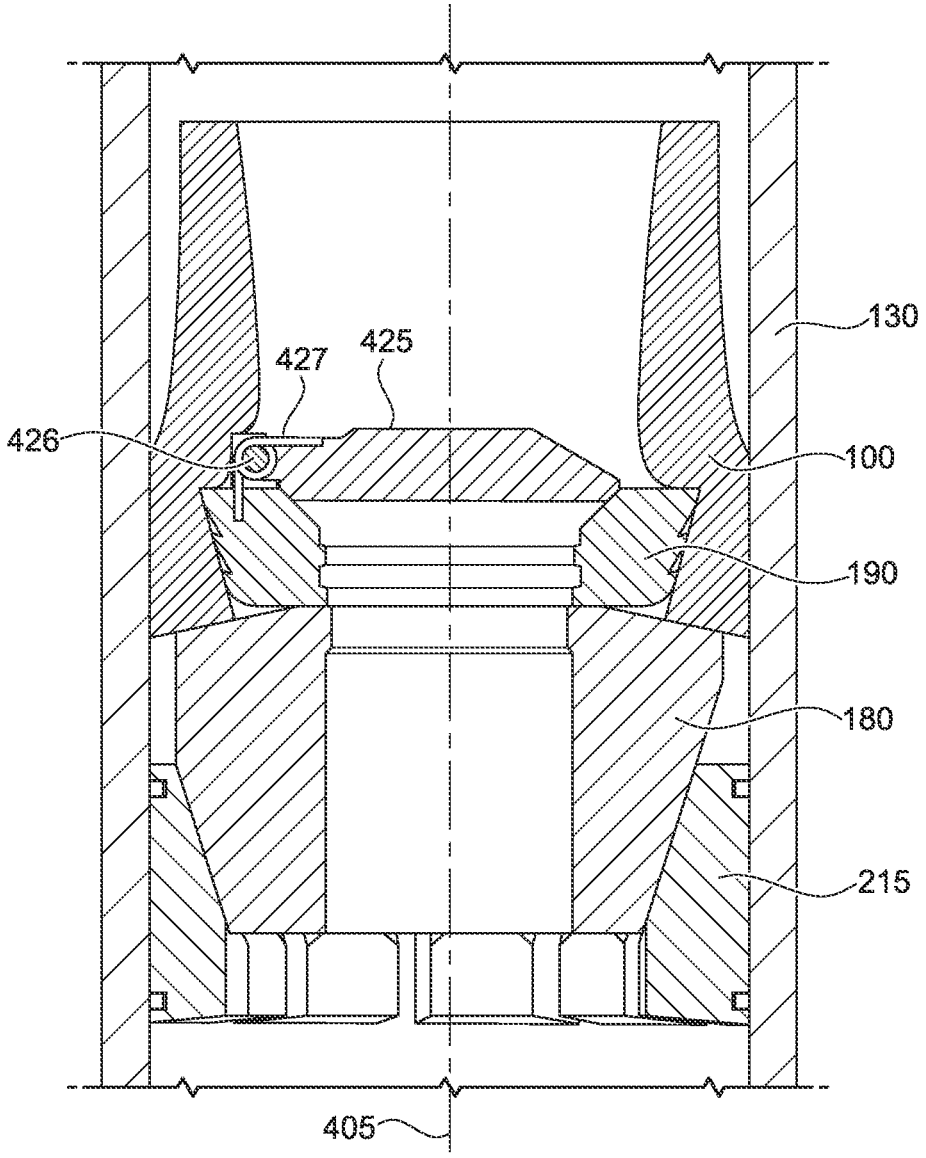
FIG. 22 is a cross-sectional view of a zonal isolation device with a rotatable sealing component after setting.

In embodiments, the rotatable sealing component 400 of the zonal isolation device 200 can be selected from a group consisting of a flapper valve (comprising a flapper 425 as shown in FIGS. 17, 21, and 22), dual flappers, a ball valve (comprising a ball 450 having a bore as shown in FIGS. 18A and 18B), an iris valve (comprising an iris diaphragm 475 as shown in FIGS. 19, 20A, and 20B), and a pinch valve.

In embodiments, the rotatable sealing component 400 remains at an axially fixed distance from the support ring 190 as a result of attachment of the rotatable sealing component 400 to the support ring 190 such that they move together (e.g., as an integrated or unified component) in an axial direction during setting of the zonal isolation device 200, which is further illustrated by the relative positioning of the rotatable sealing component 400 to the support ring 190 in the unset configuration of FIG. 21 and the set configuration of FIG. 22.

As depicted in FIG. 17, the zonal isolation device 200 comprises a rotatable sealing component 400 that around a pivot axis (e.g., parallel to the z-axis) that is perpendicular to the central axis 405 (e.g., the y-axis) and is tangential to an outer radius of the support ring 190, the outer radius of the support ring extending from the central axis 405 to an outer edge of the support ring and wherein upon rotation a contact surface of the rotatable sealing component 400 contacts a sealing surface (e.g., face or seat) of the support ring 190. In embodiments, the rotatable sealing component 400 comprises a flapper 425. In embodiments, the flapper 425 is rotatably connected to the uphole end of support ring 190 via a hinge 426, wherein the hinge 426 comprises the pivot axis (e.g., parallel to the z-axis), and upon rotation of the flapper 425 via the hinge 426 the flapper 425 contacts the sealing surface (e.g., face or seat) of the support ring 190 thereby forming a seal that provides the closed position. In embodiments, the flapper 425 is biased in the closed position by a spring 427. In embodiments, the spring 427 is a torsion spring (e.g., a flat spiral spring or a clock spring). In embodiments, as depicted in FIG. 17, the flapper 425 is biased in at least a partially closed position during and/or after actuation (e.g., setting) of the zonal isolation device 200. In an aspect, the flapper 425 is biased in at least a partially closed position by contact with sealing element 100 upon setting of the zonal isolation device. In embodiments, the pumping fluid from the surface down the wellbore provides a further closing force on the flapper 425 such that the flapper 425 transitions to or remains in a fully closed position, wherein an end of the flapper 425 opposite the hinged end contacts the sealing surface and blocks fluid flow through the zonal isolation device 200. In other words, downhole fluid flow helps to close the flapper, if needed.

In embodiments, as depicted in FIG. 21, a setting sleeve 167 is disposed around the mandrel 161 further comprises a rotation restrictor 439 (e.g., a latch or groove) that engages a flapper end 432 of the flapper 425 opposite a hinged end of the flapper 425 to hold to flapper 425 in place in the open position and protect/shield the flapper 425 during run-in (e.g., pumping) of the zonal isolation device 200 into the wellbore, wherein upon removal of the mandrel the rotatable sealing component transitions to the fully closed position.

In embodiments, as depicted in FIGS. 18A and 18B, the zonal isolation device 200 comprises a rotatable sealing component 400 that rotates around a pivot axis 460 (e.g., x-axis) that is about perpendicular with and about intersects the central axis 405 (e.g., y-axis) and wherein a contact surface of the rotatable sealing component 400 contacts a sealing surface (e.g., face or seat) of the support ring 190.

In embodiments, as depicted in FIGS. 18A and 18B, the rotatable sealing component 400 comprises a ball 450 having a bore 451 passing through the ball 450, and wherein a central axis of the bore 451 is about coaxial with the central axis 405 when the zonal isolation device 200 in an open position (FIG. 18A) and wherein the central axis of the bore 451 is about perpendicular with (e.g., z-axis) and about intersects the central axis 405 when the zonal isolation device 200 is in the closed position (FIG. 18B).

In embodiments as illustrated in FIGS. 18A and 18B, the zonal isolation device 200 further comprises a ball housing 452 connected to (or integral with) an uphole portion of the support ring 190, wherein the ball is rotatably disposed within the ball housing 452. In embodiments, the ball 450 further comprise two pins 453 positioned on opposite sides of the ball 450, wherein the pins are coaxial with the pivot axis 460 (e.g., x-axis) and wherein the pins 453 engage corresponding grooves on opposite interior surfaces of the ball housing 452 and wherein upon rotation of the ball 450 via the pins 453 a contact surface of the ball contacts the sealing surface (e.g., face or seat) of the support ring 190 thereby forming a seal that provides the closed position (FIG. 18B). In embodiments, as illustrated in FIGS. 18A and 18B, the ball 450 is biased in the closed position by a spring 427. In embodiments, the spring 427 is a torsion spring (e.g., a flat spiral spring or a clock spring). During run-in (e.g., pumping) of the zonal isolation device 200 into the wellbore, the biased ball 450 can be held in the open position by mandrel 161 of the setting tool, similar to the configuration shown in FIG. 21 for a flapper valve, wherein upon removal of the mandrel the rotatable sealing component transitions to the fully closed position.

In embodiments, as depicted in FIGS. 19, 20A, and 20B, the zonal isolation device 200 comprises a rotatable sealing component 400 that rotates around a pivot axis 460 that is parallel to and about coaxial with the central axis 405 (e.g., y-axis).

Referring to FIGS. 19, 20A, and 20B, in embodiments, the rotatable sealing component 400 comprises an iris diaphragm 475, wherein the iris diaphragm 475 rotates clockwise or counter-clockwise about the pivot axis (e.g., y-axis) to transition between the open (FIG. 20A) and closed (FIG. 20B) positions. In embodiments, the iris diaphragm 475 further comprises a plurality of blades 477 connected to a base plate 480 by a corresponding plurality of actuating arms 478. In embodiments, the rotatable sealing component 400 further comprises a cylindrical iris diaphragm housing 476 connected to an uphole portion of the support ring 190, wherein the iris diaphragm 475 is rotatably disposed within the cylindrical iris diaphragm housing 476 between the open and closed positions. In embodiments, the uphole portion of the support ring 190 further comprises a cylindrical groove 483 along an inner surface thereof, wherein the cylindrical iris diaphragm housing 476 is disposed within the cylindrical groove 483. In embodiments, the rotatable sealing component 400 further comprises a control arm 481 located in a control groove 483 of the base plate 480 such that clockwise or counterclockwise movement of the control arm 481 about the pivot axis 460 transitions the iris diaphragm 475 between the open and closed positions. In embodiments, the iris diaphragm 475 is biased in the closed position by a spring 479 applying a force to the control arm 481, wherein the spring is a helical compression spring located in the control groove 483. In embodiments, the rotatable sealing component 400 is biased to the closed position by application of a closing force by a biasing mechanism, which may be for example a pre-tensioned spring or pre-pressured hydraulic piston. During run-in (e.g., pumping) of the zonal isolation device 200 into the wellbore, the biased iris diaphragm 475 can be held in the open position by mandrel 161 of the setting tool, similar to the configuration shown in FIG. 21 for a flapper valve, wherein upon removal of the mandrel the rotatable sealing component transitions to the fully closed position.

In embodiments as shown in FIGS. 16-22, the zonal isolation device 200 does not comprise a mandrel 161, which can provide increased surface area for contact of one or more dissolvable components of the zonal isolation device 200 with a wellbore fluid. In embodiments, as depicted in FIG. 22, the end element 170 (e.g., mule shoe) detaches from the mandrel 161 upon actuation (e.g., setting) of the zonal isolation device 200, thereby providing increased surface area for contact of one or more dissolvable components of the zonal isolation device 200 with a wellbore fluid.

In embodiments as shown in FIGS. 16-22, the sealing element 100 comprises a metallic deformable material. In embodiments, the sealing element 100 further comprises a contact surface that contacts an inner surface of the wellbore (e.g., casing) upon actuation (e.g., setting) of the zonal isolation device 200 and wherein the contact surface comprises a non-metallic deformable material (e.g., polymer, elastomer, plastic, rubber, etc.).

Referring to FIGS. 17, 18A, 18B, 19, and 21, disclosed herein is a zonal isolation system, comprising: a setting tool adapter kit comprising a mandrel 161; a sealing element 100 comprising a deformable material and an inner bore 105, the sealing element 100 disposed on the mandrel 161 for sealing engagement with a downhole surface; an support ring movably disposed on the mandrel and engaged with the sealing element; a rotatable sealing component 400 directly or indirectly connected to the uphole end of the support ring 190, wherein the rotatable sealing component blocks fluid flow through the zonal isolation device 200 in a closed position and allows fluid flow through the zonal isolation device 200 in an open position and wherein the mandrel 161 is engaged with and holds the rotatable sealing component 400 in the open position while the zonal isolation device 200 is inserted into the wellbore; a wedge 180 disposed on the mandrel 161 and engaged with a downhole end of the sealing element 100; and an anchoring assembly 215 disposed on the mandrel and engaged with the wedge 180 for locking engagement with a downhole surface. In embodiments, the system further comprises an end element 170 adjacent the anchoring assembly 215 and coupled to the mandrel 161. In embodiments, the end element 170 can detachably coupled to the mandrel 161 by a shearing element.

Referring to FIG. 21, disclosed herein is a method (e.g., a method of hydraulic fracturing) comprising: inserting into a wellbore a zonal isolation device 200 having a central axis 405 and disposed on a setting tool adapter kit 160 comprising a mandrel 161; pulling upwardly on the mandrel 161 to actuate the zonal isolation device 200, wherein the upward movement of the mandrel 161 longitudinally compresses the zonal isolation device 200, causing the support ring 190 to axially move relative to the sealing element 100 and radially expand the sealing element 100 into a sealing engagement with a downhole surface (e.g., casing 130); allowing the rotatable sealing component 400 to rotate from the open position to the closed position upon removal of the mandrel 161 from engagement with the rotatable sealing component 400, whereby a wellbore zone below the zonal isolation device is isolated from fluid flow from a wellbore zone above the zonal isolation device; if not already perforated with a plurality of perforations, perforating the casing and surrounding formation with a plurality of perforations in the wellbore zone above the zonal isolation device; and pumping fluid (e.g., a fracturing fluid such as a slickwater, a gel fluid, a proppant-laden fluid) from the surface down the wellbore and into the formation via the plurality of perforations in the wellbore zone above the zonal isolation device and fracturing the formation, wherein a sealing device such as a ball is not required to be pumped from the surface in order to prevent fluid flow through the zonal isolation device 200 and divert the fluid into the perforations and surrounding formation. Upon completion of setting/actuating, and removal of the mandrel 161, the set zonal isolation device 200 is as shown in FIG. 22.

In embodiments, the method as disclosed herein employs a zonal isolation device 200 comprising: a sealing element 100 comprising a deformable material and an inner bore 105; an support ring 190 (also referred to as a frustrum having a conical shape) movably disposed within the inner bore 105 of the sealing element 100; a rotatable sealing component 400 directly or indirectly connected to the uphole end of the support ring 190, wherein the rotatable sealing component blocks fluid flow through the zonal isolation device 200 in a closed position and allows fluid flow through the zonal isolation device 200 in an open position and wherein a mandrel 161 of a setting tool is engaged with and holds the rotatable sealing component 400 in the open position while the zonal isolation device 200 is inserted into the wellbore; a wedge 180 engaged with a downhole end of the sealing element 100; an anchoring assembly 215 engaged with the wedge 180; and an end element 170 (e.g., a mule shoe) adjacent the anchoring assembly 215 and detachably coupled to the mandrel 161.

Referring to FIGS. 23-27, in embodiments, the zonal isolation device 200 comprises a flapper coupled to and supported by a support ring 190. In embodiments, the zonal isolation device 200 with a flapper coupled to and supported by a support ring 190 can comprise: a sealing element 100 comprising a deformable material and an inner bore 105; a support ring 190 (also referred to as a frustrum having a conical shape) movably disposed within the inner bore 105 of the sealing element 100; a flapper connected to an uphole end of the support ring 190 and configured to engage a sealing surface (e.g., face or seat) of support ring 190, wherein the flapper blocks fluid flow through the zonal isolation device 200 in a fully closed position, allows unrestricted fluid flow through the zonal isolation device 200 in a fully open position, and allows restricted fluid flow through the zonal isolation device 200 when held by a propping component (also referred to as a propping member) in an intermediate or partially open position; a wedge 180 engaged with a downhole end of the sealing element 100; an anchoring assembly 215 engaged with the wedge 180; and an end element 170 (e.g., a mule shoe) adjacent the anchoring assembly 215.

Referring to FIGS. 23-27, in embodiments, the zonal isolation device 200 can be a zonal isolation device with a flapper coupled to and supported by a mandrel. In embodiments, the zonal isolation device with a flapper coupled to and supported by a mandrel can comprise: a mandrel having a bore extending axially there through; an anchoring assembly (e.g., slip) circumferentially disposed about the mandrel and configured to expand and engage with a downhole surface; a sealing element circumferentially disposed about the mandrel and configured to compress and create a seal with the downhole surface; and a flapper coupled to the mandrel and configured to engage a sealing surface (e.g., face or seat) of an end of the mandrel and seal the bore of the mandrel, wherein the flapper blocks fluid flow through the zonal isolation device in a fully closed position, allows unrestricted fluid flow through the zonal isolation device in a fully open position, and allows restricted fluid flow through the zonal isolation device when held by a propping component (also referred to as a propping member) in an intermediate or partially open position.

The embodiments shown in FIGS. 23-27 are applicable to either a zonal isolation device with a flapper coupled to and supported by a support ring or a zonal isolation device with a flapper coupled to and supported by a mandrel. In the following description, a "zonal isolation device" can be referred to as either a zonal isolation device with flapper on a support ring or a zonal isolation device with flapper on a mandrel.

Figure 25:
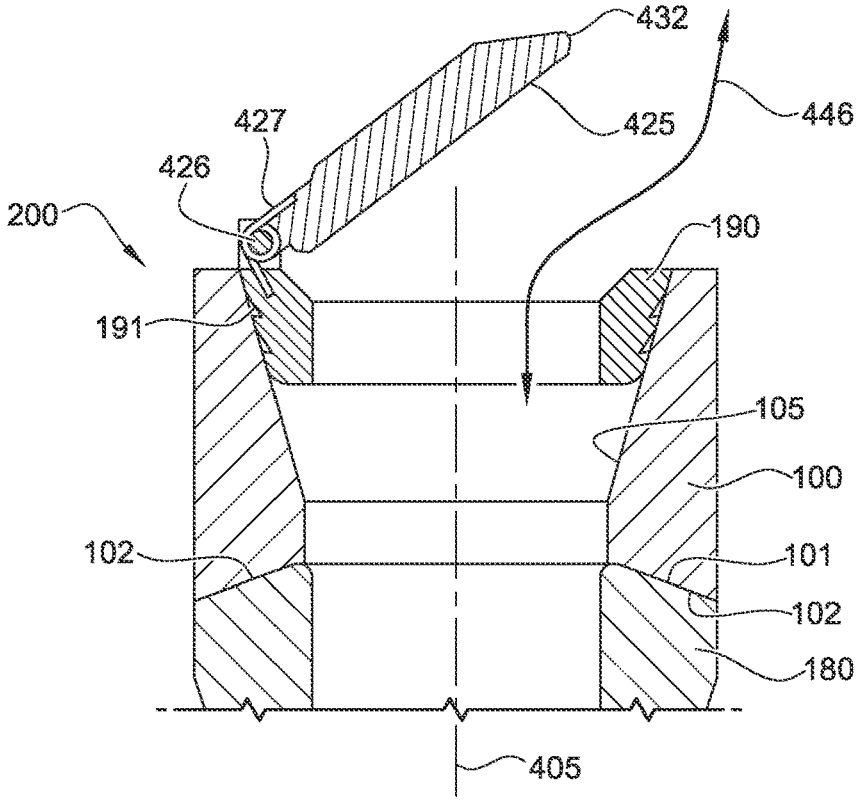
FIG. 25 is a cross-sectional view of a zonal isolation device with a propped flapper with a spring as the propping component according to certain embodiments of the present disclosure.
Figure 26:
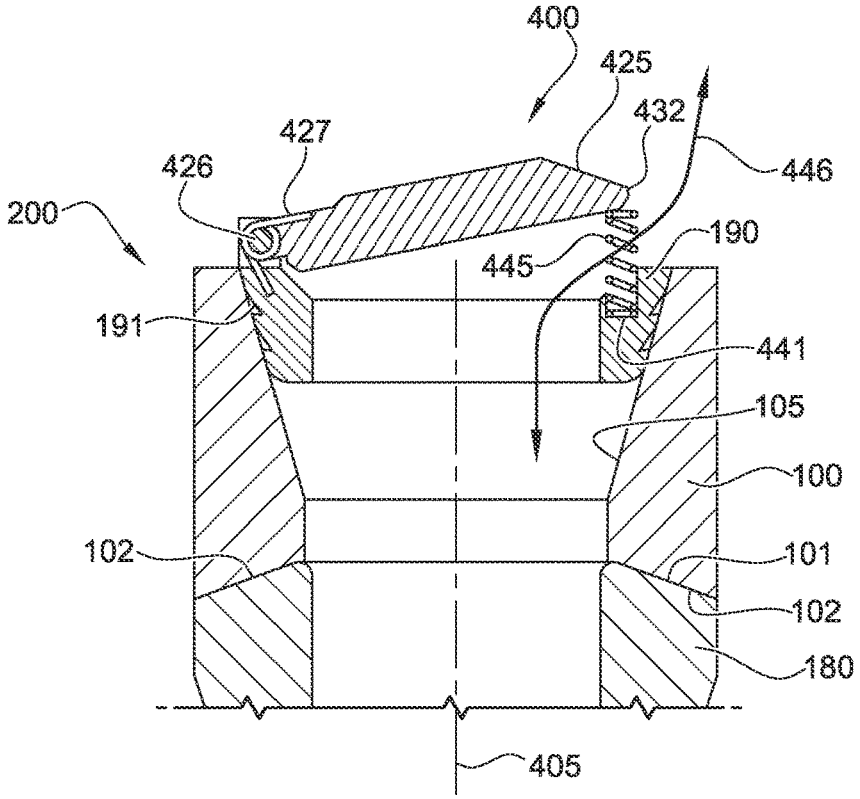
FIG. 26 is a cross-sectional view of a zonal isolation device with a propped flapper with a spring as the propping component according to certain embodiments of the present disclosure.

In embodiments, as shown in FIGS. 25 and 26, flapper 425 is propped partially open (e.g., in an intermediate position) via a propping component, wherein the propping component comprises a spring (e.g., spring 427 and/or spring 445). In embodiments as shown in FIG. 25, the spring is a torsion spring 427 (e.g., a flat spiral spring or a clock spring), wherein the torsion spring is positioned adjacent a hinged end of the flapper and wherein the torsion spring holds the flapper in the intermediate position when the torsion spring is in a neutral or equilibrium (e.g., non-compressed and non-stretched) state/condition, thereby allowing fluid flow via a gap formed between flapper end 432 and the sealing surface as indicated by flow arrow 446. In embodiments as shown in FIG. 26, the spring is a coil spring 445, wherein a first end of the coil spring is received within a recess 441 in the uphole end of the support ring 190 and a second end of the coil spring 445 contacts flapper end 432, wherein the coil spring holds the flapper in the intermediate position when the coil spring is in a neutral or equilibrium (e.g., non-compressed and non-stretched) state/condition, thereby allowing fluid flow via a gap formed between flapper end 432 and the sealing surface as indicated by flow arrow 446.

Figure 27:
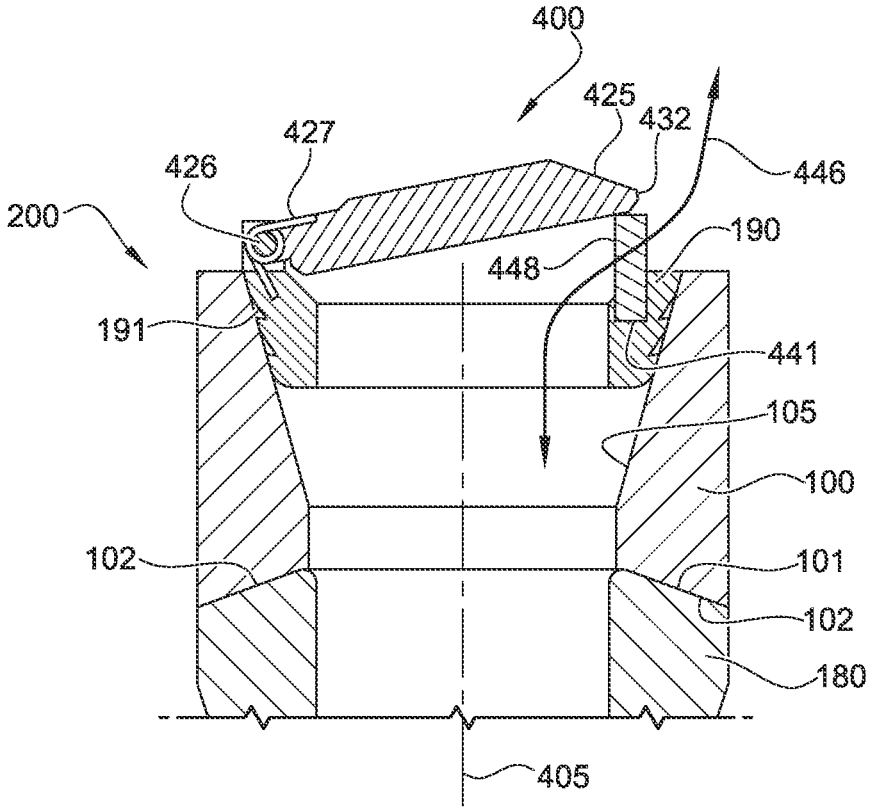
FIG. 27 is a cross-sectional view of a zonal isolation device with a propped flapper with a strut as the propping component according to certain embodiments of the present disclosure.

In embodiments, as shown in FIG. 27, flapper 425 is propped partially open (e.g., in an intermediate position) via a propping component, wherein the propping component comprises a strut 448. In embodiments, a first end of the strut 448 is received within a recess 441 in the uphole end of the support ring 190 and a second end of the strut 448 contacts flapper end 432, wherein the strut holds the flapper in the intermediate position, thereby allowing fluid flow via a gap formed between flapper end 432 and the sealing surface as indicated by flow arrow 446. In embodiments, the strut comprises a dissolvable material, a degradable material, an erodible material, an abradable material, a temperature-sensitive material (e.g., a fusible alloy), a corrodible material, a frangible material, or combinations thereof and is configured such that the strut loses structural integrity when subjected to contact with a wellbore fluid (e.g., downhole fluid flow), downhole ambient conditions (e.g., temperature and/or pressure), or both, thereby allowing the flapper to transition from the intermediate position to the fully closed position.

Figure 23:
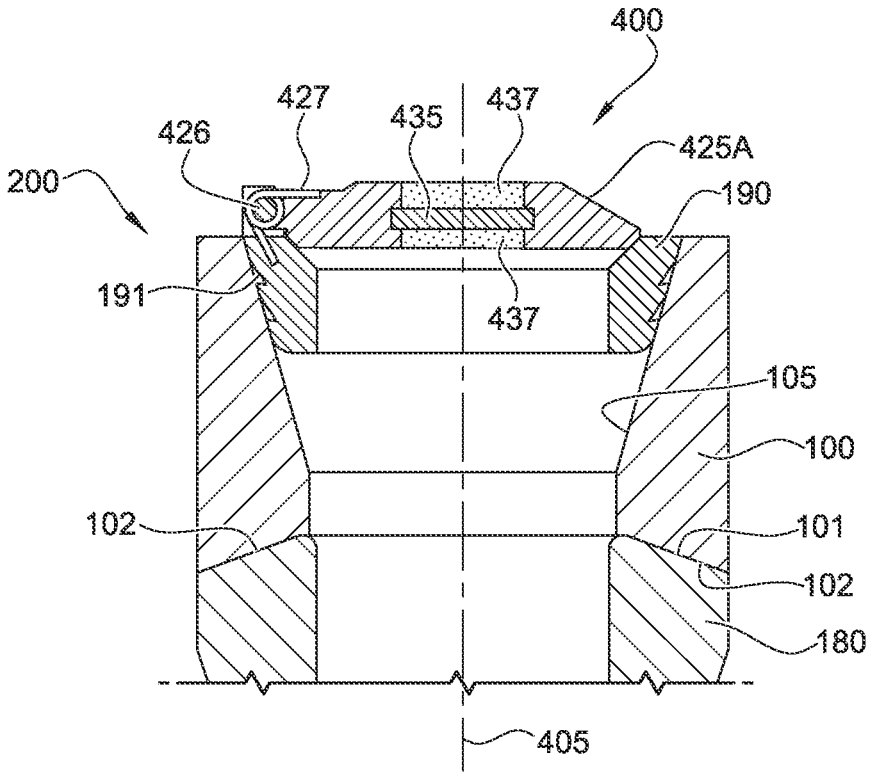
FIG. 23 is a cross-sectional view of a zonal isolation device with a flapper with a rupture disc according to certain embodiments of the present disclosure.

In embodiments, as shown in FIG. 23, the flapper further comprises a rupture disk 435 (also referred to as a burst disk or burst diaphragm), which optionally may be protected by one or more coating layers 437. The coating layers 437 are for protection only and do not prevent application of pressure on the rupture disk or otherwise hinder operation of the rupture disk. In embodiments, the rupture disk 435 is disposed within a circumferential groove on an interior face of a hole passing through the flapper. The flapper with rupture disk as shown in FIG. 23 may be incorporated with any other embodiment herein referencing use of a flapper, including without limitation the embodiments as shown in any of FIGS. 16, 17, and 21-27.

Figure 24:
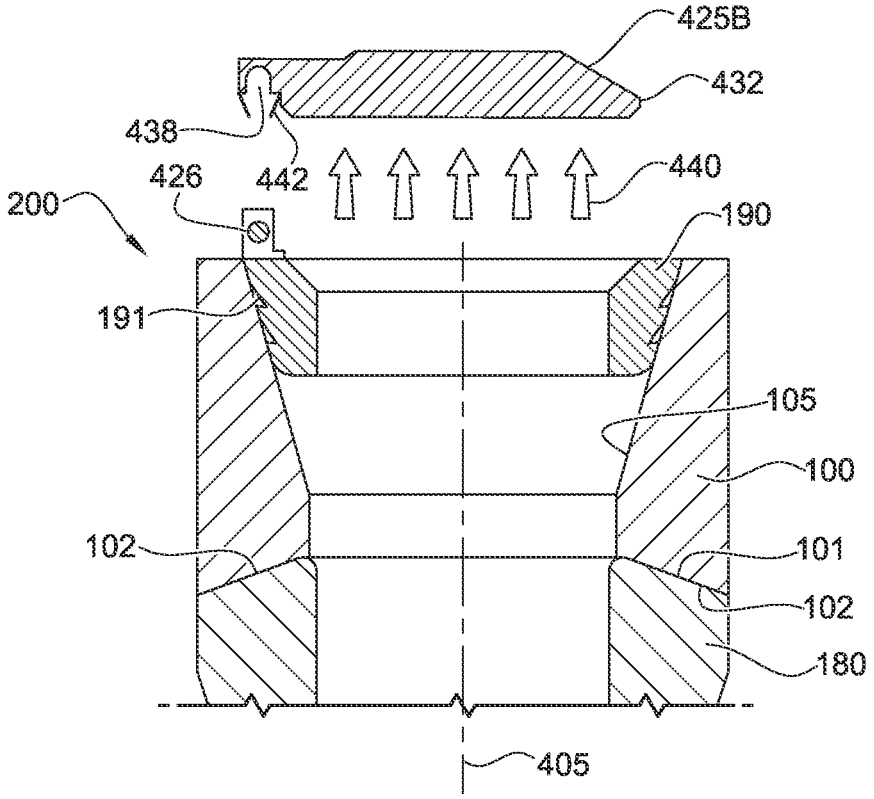
FIG. 24 is a cross-sectional view of a zonal isolation device with a flapper with a releasable hinge according to certain embodiments of the present disclosure.

In embodiments, as shown in FIG. 24, the flapper further comprises a releasable hinge configured to decouple an end of the flapper proximate the releasable hinge. In embodiments, the releasable hinge comprises a pivot pin and wherein the end of the flapper proximate the releasable hinge comprises a u-shaped recess 438 receiving the pivot pin and a clip 442 (e.g., a pinch clip) engaging the pivot pin, wherein the flapper is configured to decouple from the releasable hinge via application of a releasing force sufficient to overcome a retaining force applied to the releasable hinge by the clip 442, for example a releasing force applied via flow of wellbore fluid as represented by flow arrows 440. The flapper with releasable hinge as shown in FIG. 24 may be incorporated with any other embodiment herein referencing use of a flapper, including without limitation the embodiments as shown in any of FIGS. 16, 17, and 21-27.

Referring to FIG. 23, in embodiments, a zonal isolation device 200 with a flapper coupled to and supported by a support ring 190 comprises: a sealing element 100 comprising a deformable material and an inner bore 105; a support ring 190 (also referred to as a frustrum having a conical shape) movably disposed within the inner bore 105 of the sealing element 100; a flapper connected to an uphole end of the support ring 190 and configured to engage a sealing surface (e.g., face or seat) of support ring 190, wherein the flapper blocks fluid flow through the zonal isolation device 200 in a fully closed position and allows unrestricted fluid flow through the zonal isolation device 200 in a fully open position and wherein the flapper further comprises a rupture disk 435 (also referred to as a burst disk or burst diaphragm), which optionally may be protected by one or more coating layers 437; a wedge 180 engaged with a downhole end of the sealing element 100; an anchoring assembly 215 engaged with the wedge 180; and an end element 170 (e.g., a mule shoe) adjacent the anchoring assembly 215.

Referring to FIG. 23, in embodiments, a zonal isolation device with a flapper coupled to and supported by a mandrel comprises: a mandrel having a bore extending axially there through; an anchoring assembly (e.g., slip) circumferentially disposed about the mandrel and configured to expand and engage with a downhole surface; a sealing element circumferentially disposed about the mandrel and configured to compress and create a seal with the downhole surface; and a flapper coupled to the mandrel and configured to engage a sealing surface (e.g., face or seat) of an end of the mandrel and seal the bore of the mandrel, wherein the flapper blocks fluid flow through the zonal isolation device in a fully closed position and allows unrestricted fluid flow through the zonal isolation device in a fully open position and wherein the flapper further comprises a rupture disk 435 (also referred to as a burst disk or burst diaphragm), which optionally may be protected by one or more coating layers 437.

In embodiments, the zonal isolation device in FIG. 23 as disclosed herein, wherein the rupture disk is disposed within a circumferential groove on an interior face of a hole passing through the flapper.

Referring to FIG. 24, in embodiments, the zonal isolation device 200 with a flapper coupled to and supported by a support ring 190 comprises: a sealing element 100 comprising a deformable material and an inner bore 105; a support ring 190 (also referred to as a frustrum having a conical shape) movably disposed within the inner bore 105 of the sealing element 100; a flapper connected to an uphole end of the support ring 190 and configured to engage a sealing surface (e.g., face or seat) of support ring 190, wherein the flapper blocks fluid flow through the zonal isolation device 200 in a fully closed position and allows unrestricted fluid flow through the zonal isolation device 200 in a fully open position and wherein the flapper further comprises a releasable hinge configured to decouple an end of the flapper proximate the releasable hinge; a wedge 180 engaged with a downhole end of the sealing element 100; an anchoring assembly 215 engaged with the wedge 180; and an end element 170 (e.g., a mule shoe) adjacent the anchoring assembly 215.

Referring to in FIG. 24, in embodiments, the zonal isolation device with a flapper coupled to and supported by a mandrel comprises: a mandrel having a bore extending axially there through; an anchoring assembly (e.g., slip) circumferentially disposed about the mandrel and configured to expand and engage with a downhole surface; a sealing element circumferentially disposed about the mandrel and configured to compress and create a seal with the downhole surface; and a flapper coupled to the mandrel and configured to engage a sealing surface (e.g., face or seat) of an end of the mandrel and seal the bore of the mandrel, wherein the flapper blocks fluid flow through the zonal isolation device in a fully closed position and allows unrestricted fluid flow through the zonal isolation device in a fully open position and wherein the flapper further comprises a releasable hinge configured to decouple an end of the flapper proximate the releasable hinge.

In embodiments, the zonal isolation device in FIG. 24 as disclosed herein, wherein the releasable hinge comprises a pivot pin and wherein the end of the flapper proximate the releasable hinge comprises a u-shaped recess 438 receiving the pivot pin and a clip 442 (e.g., a pinch clip) engaging the pivot pin, wherein the flapper is configured to decouple from the releasable hinge via application of a releasing force sufficient to overcome a retaining force applied to the releasable hinge by the clip 442, for example a releasing force applied via flow of wellbore fluid as represented by flow arrows 440.

Disclosed herein is a method (e.g., a method of hydraulic fracturing) comprising: inserting into a cased wellbore the zonal isolation device (e.g., a zonal isolation device with a flapper coupled to and supported by a support ring or a zonal isolation device with a flapper coupled to and supported by a mandrel) with a propping component as disclosed herein (e.g., a flapper propped open as shown in any of FIGS. 25-27); actuating the zonal isolation device to provide a set zonal isolation device; detaching a setting tool assembly from the set zonal isolation device; moving the setting tool assembly uphole from the set zonal isolation device, wherein the setting tool assembly is coupled to one or more perforating guns located uphole from the setting tool assembly; sending a trigger signal to the one or more perforating guns; and upon failure of at least one of the perforating guns to fire, pumping one or more replacement perforating guns down the wellbore to a desired location, wherein during the pumping the propping component (as shown in any of FIGS. 25-27) holds the flapper in the intermediate position and provides for restricted flow of a wellbore fluid through the zonal isolation device.

In embodiments, the method as disclosed herein further comprises: sending a trigger signal to the one or more replacement perforating guns; and forming a plurality of perforations through the casing and into the surrounding formation in a wellbore zone located above the set zonal isolation device. In embodiments, the method further comprises: removing the setting tool assembly, the one or more perforating guns coupled to the setting tool assembly, and the one or more replacement perforating guns from the wellbore.

Referring to FIG. 27, in embodiments, the method further comprises: structurally compromising the propping component 448 such that the flapper 425 can transition to the fully closed position, whereby a wellbore zone below the set zonal isolation device is isolated from fluid flow from the wellbore zone above the set zonal isolation device.

In embodiments, the propping component 448 comprises a degradable material, an erodible material, or an abradable material and is structurally compromised via contact with a flowing wellbore fluid that removes all or a portion of the degradable material, the erodible material, or the abradable material.

In embodiments, the propping component 448 comprises a dissolvable material or a corrodible material and is structurally compromised via contact with a wellbore fluid (e.g., via chemical decomposition of the strut, dissolution of the strut, etc.).

In embodiments, the propping component 448 comprises a temperature-sensitive material (e.g., a fusible alloy) and is structurally compromised via change in ambient temperature in the wellbore proximate the set zonal isolation plug. In embodiments, the change in ambient temperature is controlled by adjusting (e.g., halting) a flow of fluid in the wellbore, thereby allowing the temperature in the wellbore proximate the set zonal isolation plug to increase and soften the temperature-sensitive material.

In embodiments, the propping component 448 comprises a frangible material and is structurally compromised via contact with a pressure wave. In embodiments, the pressure wave is produced via a fluid pulse from the surface or from firing of a perforating gun (e.g., a shock wave).

Referring to FIGS. 25 and 26, in embodiments, the method as disclosed herein, after removing the setting tool assembly, the one or more perforating guns coupled to the setting tool assembly, and the one or more replacement perforating guns from the wellbore, the method further comprises: applying a closing force on the flapper that is greater than a spring force applied by spring 427 and/or spring 445 to transition the flapper from the intermediate position to the fully closed position, wherein the closing force results from contact with fluid flowing into the wellbore.

In embodiments, the method as disclosed herein referring to FIGS. 25-27, further comprises pumping fluid (e.g., a fracturing fluid such as a slickwater, a gel fluid, a proppant-laden fluid) from the surface down the wellbore and into the formation via the plurality of perforations in the wellbore zone above the set zonal isolation device and fracturing the formation, wherein a sealing device such as a ball is not required to be pumped from the surface in order to prevent fluid flow through the zonal isolation device and divert the fluid into the perforations and surrounding formation. In embodiments, the flapper comprises a rupture disk, and the method further comprises rupturing the rupture disk to provide for fluid flow through the set zonal isolation device, wherein the fluid flow enhances the dissolution rate of one or more dissolvable components of the zonal isolation device. In embodiments, the flapper comprises a releasable hinge, and the method further comprises decoupling an end of the flapper proximate the releasable hinge to remove the flapper from contact with the sealing surface to provide for fluid flow through the set zonal isolation device, wherein the fluid flow enhances the dissolution rate of one or more dissolvable components of the zonal isolation device.

Also, disclosed herein is a method (e.g., a method of hydraulic fracturing) comprising: inserting into a cased wellbore the zonal isolation device with a propping component as disclosed herein (e.g., a flapper propped open as shown in any of FIGS. 25-27); actuating the zonal isolation device to provide a set zonal isolation device; detaching a setting tool assembly from the set zonal isolation device; moving the setting tool assembly uphole from the set zonal isolation device, wherein the setting tool assembly is coupled to one or more perforating guns located uphole from the setting tool assembly; sending a trigger signal to the one or more perforating guns; forming a plurality of perforations through the casing and into the surrounding formation in a wellbore zone located above the set zonal isolation device; removing the setting tool assembly and the one or more perforating guns coupled to the setting tool assembly from the wellbore; either (i) as in FIG. 27, structurally compromising the propping component such that the flapper can transition to the fully closed position, whereby a wellbore zone below the set zonal isolation device is isolated from fluid flow from the wellbore zone above the set zonal isolation device, wherein the propping component is structurally compromised or (ii) as in FIGS. 25-26, applying a closing force on the flapper that is greater than a spring force applied by spring 427 and/or spring 445 to transition the flapper from the intermediate position to the fully closed position, wherein the closing force results from contact with fluid flowing into the wellbore; and pumping fluid (e.g., a fracturing fluid such as a slickwater, a gel fluid, a proppant-laden fluid) from the surface down the wellbore and into the formation via the plurality of perforations in the wellbore zone above the set zonal isolation device and fracturing the formation, wherein a sealing device such as a ball is not required to be pumped from the surface in order to prevent fluid flow through the zonal isolation device and divert the fluid into the perforations and surrounding formation. In embodiments, the flapper comprises a rupture disk as in FIG. 23, and the method further comprises rupturing the rupture disk to provide for fluid flow through the set zonal isolation device, wherein the fluid flow enhances the dissolution rate of one or more dissolvable components of the zonal isolation device. In embodiments, the flapper comprises a releasable hinge as in FIG. 24, and the method further comprises decoupling an end of the flapper proximate the releasable hinge to remove the flapper from contact with the sealing surface to provide for fluid flow through the set zonal isolation device, wherein the fluid flow enhances the dissolution rate of one or more dissolvable components of the zonal isolation device.

Referring to FIG. 23, disclosed herein is a method (e.g., a method of hydraulic fracturing) comprising: inserting into a cased wellbore the zonal isolation device; actuating the zonal isolation device to provide a set zonal isolation device, wherein the flapper transitions to the fully closed position and a wellbore zone below the set zonal isolation device is isolated from fluid flow from a wellbore zone above the set zonal isolation device; detaching a setting tool assembly from the set zonal isolation device; moving the setting tool assembly uphole from the set zonal isolation device, wherein the setting tool assembly is coupled to one or more perforating guns located uphole from the setting tool assembly; sending a trigger signal to the one or more perforating guns; forming a plurality of perforations through the casing and into the surrounding formation in a wellbore zone located above the set zonal isolation device; removing the setting tool assembly and the one or more perforating guns coupled to the setting tool assembly from the wellbore; pumping fluid (e.g., a fracturing fluid such as a slickwater, a gel fluid, a proppant-laden fluid) from the surface down the wellbore and into the formation via the plurality of perforations in the wellbore zone above the set zonal isolation device and fracturing the formation, wherein a sealing device such as a ball is not required to be pumped from the surface in order to prevent fluid flow through the set zonal isolation device and divert the fluid into the perforations and surrounding formation; and rupturing the rupture disk to provide for fluid flow through the set zonal isolation device, wherein the fluid flow through the set zonal isolation device enhances the dissolution rate of one or more dissolvable components of the zonal isolation device.

Referring to FIG. 24, disclosed herein is a method (e.g., a method of hydraulic fracturing) comprising: inserting into a cased wellbore the zonal isolation device; actuating the zonal isolation device to provide a set zonal isolation device, wherein the flapper transitions to the fully closed position and a wellbore zone below the set zonal isolation device is isolated from fluid flow from a wellbore zone above the set zonal isolation device; detaching a setting tool assembly from the set zonal isolation device; moving the setting tool assembly uphole from the set zonal isolation device, wherein the setting tool assembly is coupled to one or more perforating guns located uphole from the setting tool assembly; sending a trigger signal to the one or more perforating guns; forming a plurality of perforations through the casing and into the surrounding formation in a wellbore zone located above the set zonal isolation device; removing the setting tool assembly and the one or more perforating guns coupled to the setting tool assembly from the wellbore; pumping fluid (e.g., a fracturing fluid such as a slickwater, a gel fluid, a proppant-laden fluid) from the surface down the wellbore and into the formation via the plurality of perforations in the wellbore zone above the set zonal isolation device and fracturing the formation, wherein a sealing device such as a ball is not required to be pumped from the surface in order to prevent fluid flow through the set zonal isolation device and divert the fluid into the perforations and surrounding formation; and decoupling an end of the flapper proximate the releasable hinge to remove the flapper from contact with the sealing surface to provide for fluid flow through set zonal isolation device, wherein the fluid flow through the set isolation device enhances the dissolution rate of one or more dissolvable components of the zonal isolation device.

One advantage of the disclosure is to be able to avoid the act of pumping a ball onto the frac plug for sealing purpose to divert the fracturing fluid into the perforations and surrounding formation. The pumping of the ball increases the water usage and increases the operating time for each stage of fracturing. Also a traditional spring loaded ball does not work with a bottom-set plug because the ball blocks the usage of the setting tool. By avoiding the usage of the ball, the disclosure saves water and operating time for each stage of fracturing, and can be used with a bottom-set plug. Another advantage is that the disclosure simplifies the design, reduces the leak paths, and reduces the cost of the frac plug, by attaching a rotatable flow restrictor (a rotatable sealing component 400) at an axially fixed distance with respect to the frustrum of the frac plug that supports the sealing surface. There are no other frac plugs, especially dissolvable frac plugs, that have a rotatable flow restrictor at an axially fixed distance with respect to the frustrum of the frac plug that supports the sealing surface. This disclosure can be applied to a dissolvable frac plug, such as the Sprire™ frac plug, which is commercially available from Halliburton Energy Services, Inc. Another advantage is that there is no mandrel in the frac plug in this disclosure after the plug is set. The feature of no mandrel simplifies the design, thus reduces the amount of material used which aids in dissolution or milling, and lowers the cost of the plug. Another advantage is that the mule shoe (the end element 170) of this design falls away after the setting process. The lack of a mandrel and the removal of the mule shoe provides for increased surface area for contact with a wellbore fluid, which allows for a more controlled (e.g., faster) dissolution process.

Additional Disclosure

The following enumerated aspects of the present disclosure are provided as non-limiting examples.

A first embodiment, which is a zonal isolation device 200 comprising a sealing element 100 comprising a deformable material and an inner bore 105, a support ring 190 (also referred to as an expansion ring, for example a frustrum having a conical shape) movably disposed within the inner bore 105 of the sealing element 100, a rotatable seal connected to the support ring 190 and configured to engage a sealing surface (e.g., face or seat) of support ring 190, wherein the flapper is configured to restrict fluid flow through the zonal isolation device 200 in a closed position, is configured to minimally restrict fluid flow through the zonal isolation device 200 in a fully open position.

A second embodiment, which is a zonal isolation device comprising a mandrel having a bore extending axially there through, an anchoring assembly (e.g., slip) circumferentially disposed about the mandrel and configured to expand and engage with a downhole surface, a sealing element circumferentially disposed about the mandrel and configured to compress and create a seal with the downhole surface, and a flapper coupled to the mandrel and configured to engage a sealing surface (e.g., face or seat) of an end of the mandrel and seal the bore of the mandrel, wherein the flapper blocks fluid flow through the zonal isolation device in a fully closed position, allows unrestricted fluid flow through the zonal isolation device in a fully open position, and allows restricted fluid flow through the zonal isolation device when held by a propping component (also referred to as a propping member) in an intermediate or partially open position.

A third embodiment, which is the device of the first or the second embodiment, wherein the propping component comprises a spring (427 and/or 445).

A fourth embodiment, which is the device of the third embodiment, wherein the spring is a torsion spring 427 (e.g., a flat spiral spring or a clock spring), wherein the torsion spring is positioned adjacent a hinged end of the flapper and wherein the torsion spring holds the flapper in the intermediate position when the torsion spring is in a neutral or equilibrium (e.g., non-compressed and non-stretched) state/condition, thereby allowing fluid flow via a gap formed between flapper end 432 and the sealing surface as indicated by flow arrow 446.

A fifth embodiment, which is the device of the third embodiment, wherein the spring is a coil spring 445, wherein a first end of the coil spring is received within a recess 441 in the uphole end of the support ring 190 and a second end of the coil spring 445 contacts flapper end 432, wherein the coil spring holds the flapper in the intermediate position when the coil spring is in a neutral or equilibrium (e.g., non-compressed and non-stretched) state/condition, thereby allowing fluid flow via a gap formed between flapper end 432 and the sealing surface as indicated by flow arrow 446.

A sixth embodiment, which is the device of the first or the third embodiment, wherein the propping component comprises a strut 448.

A seventh embodiment, which is the device of the sixth embodiment, wherein a first end of the strut 448 is received within a recess 441 in the uphole end of the support ring 190 and a second end of the strut 448 contacts flapper end 432, wherein the strut holds the flapper in the intermediate position, thereby allowing fluid flow via a gap formed between flapper end 432 and the sealing surface as indicated by flow arrow 446.

An eighth embodiment, which is the device of the seventh embodiment, wherein the strut comprises a dissolvable material, a degradable material, an erodible material, an abradable material, a temperature-sensitive material (e.g., a fusible alloy), a corrodible material, a frangible material, or combinations thereof and is configured such that the strut loses structural integrity when subjected to contact with a wellbore fluid (e.g., downhole fluid flow), downhole ambient conditions (e.g., temperature and/or pressure), or both, thereby allowing the flapper to transition from the intermediate position to the fully closed position.

A ninth embodiment, which is the device of any of the first through the eighth embodiments, wherein the flapper further comprises a rupture disk 435 (also referred to as a burst disk or burst diaphragm), which optionally may be protected by one or more coating layers 437. The coating layers 437 are for protection only and do not prevent application of pressure on the rupture disk or otherwise hinder operation of the rupture disk.

A tenth embodiment, which is the device of the ninth embodiment, wherein the rupture disk is disposed within a circumferential groove on an interior face of a hole or bore passing through the flapper.

An eleventh embodiment, which is the device of any of the first through the tenth embodiments, wherein the flapper further comprises a releasable hinge configured to decouple an end of the flapper proximate the releasable hinge.

A twelfth embodiment, which is the device of the eleventh embodiment, wherein the releasable hinge comprises a pivot pin and wherein the end of the flapper proximate the releasable hinge comprises a u-shaped recess 438 receiving the pivot pin and a clip 442 (e.g., a pinch clip) engaging the pivot pin, wherein the flapper is configured to decouple from the releasable hinge via application of a releasing force sufficient to overcome a retaining force applied to the releasable hinge by the clip 442, for example a releasing force applied via flow of wellbore fluid as represented by flow arrows 440.

A thirteenth embodiment, which is a zonal isolation device 200 comprising a sealing element 100 comprising a deformable material and an inner bore 105, a support ring 190 (also referred to as a frustrum having a conical shape) movably disposed within the inner bore 105 of the sealing element 100, a flapper connected to an uphole end of the support ring 190 and configured to engage a sealing surface (e.g., face or seat) of support ring 190, wherein the flapper blocks fluid flow through the zonal isolation device 200 in a fully closed position and allows unrestricted fluid flow through the zonal isolation device 200 in a fully open position and wherein the flapper further comprises a rupture disk 435 (also referred to as a burst disk or burst diaphragm), which optionally may be protected by one or more coating layers 437, a wedge 180 engaged with a downhole end of the sealing element 100, an anchoring assembly 215 engaged with the wedge 180, and an end element 170 (e.g., a mule shoe) adjacent the anchoring assembly 215.

A fourteenth embodiment, which is a zonal isolation device comprising a mandrel having a bore extending axially there through, an anchoring assembly (e.g., slip) circumferentially disposed about the mandrel and configured to expand and engage with a downhole surface, a sealing element circumferentially disposed about the mandrel and configured to compress and create a seal with the downhole surface, and a flapper coupled to the mandrel and configured to engage a sealing surface (e.g., face or seat) of an end of the mandrel and seal the bore of the mandrel, wherein the flapper blocks fluid flow through the zonal isolation device in a fully closed position and allows unrestricted fluid flow through the zonal isolation device in a fully open position and wherein the flapper further comprises a rupture disk 435 (also referred to as a burst disk or burst diaphragm), which optionally may be protected by one or more coating layers 437.

A fifteenth embodiment, which is the device of the thirteenth or the fourteenth embodiment, wherein the rupture disk is disposed within a circumferential groove on an interior face of a hole passing through the flapper.

A sixteenth embodiment, which is a zonal isolation device 200 comprising a sealing element 100 comprising a deformable material and an inner bore 105, a support ring 190 (also referred to as a frustrum having a conical shape) movably disposed within the inner bore 105 of the sealing element 100, a flapper connected to an uphole end of the support ring 190 and configured to engage a sealing surface (e.g., face or seat) of support ring 190, wherein the flapper blocks fluid flow through the zonal isolation device 200 in a fully closed position and allows unrestricted fluid flow through the zonal isolation device 200 in a fully open position and wherein the flapper further comprises a releasable hinge configured to decouple an end of the flapper proximate the releasable hinge, a wedge 180 engaged with a downhole end of the sealing element 100, an anchoring assembly 215 engaged with the wedge 180, and an end element 170 (e.g., a mule shoe) adjacent the anchoring assembly 215.

A seventeenth embodiment, which is a zonal isolation device comprising a mandrel having a bore extending axially there through, an anchoring assembly (e.g., slip) circumferentially disposed about the mandrel and configured to expand and engage with a downhole surface, a sealing element circumferentially disposed about the mandrel and configured to compress and create a seal with the downhole surface, and a flapper coupled to the mandrel and configured to engage a sealing surface (e.g., face or seat) of an end of the mandrel and seal the bore of the mandrel, wherein the flapper blocks fluid flow through the zonal isolation device in a fully closed position and allows unrestricted fluid flow through the zonal isolation device in a fully open position and wherein the flapper further comprises a releasable hinge configured to decouple an end of the flapper proximate the releasable hinge.

An eighteenth embodiment, which is the device of the sixteenth or the seventeenth embodiment, wherein the releasable hinge comprises a pivot pin and wherein the end of the flapper proximate the releasable hinge comprises a u-shaped recess 438 receiving the pivot pin and a clip 442 (e.g., a pinch clip) engaging the pivot pin, wherein the flapper is configured to decouple from the releasable hinge via application of a releasing force sufficient to overcome a retaining force applied to the releasable hinge by the clip 442, for example a releasing force applied via flow of wellbore fluid as represented by flow arrows 440.

A nineteenth embodiment, which is a method comprising inserting into a cased wellbore the zonal isolation device of any of the first through the twelfth embodiments, actuating the zonal isolation device to provide a set zonal isolation device, detaching a setting tool assembly from the set zonal isolation device, moving the setting tool assembly uphole from the set zonal isolation device, wherein the setting tool assembly is coupled to one or more perforating guns located uphole from the setting tool assembly, sending a trigger signal to the one or more perforating guns, and upon failure of at least one of the perforating guns to fire, pumping one or more replacement perforating guns down the wellbore to a desired location, wherein during the pumping the propping component holds the rotatable sealing component (e.g., flapper) in the intermediate position and provides for restricted flow of a wellbore fluid through the zonal isolation device.

A twentieth embodiment, which is the method of the nineteenth embodiment, further comprising sending a trigger signal to the one or more replacement perforating guns, and forming a plurality of perforations through the casing and into the surrounding formation in a wellbore zone located above the set zonal isolation device.

A twenty-first embodiment, which is the method of the twentieth embodiment, further comprising removing the setting tool assembly, the one or more perforating guns coupled to the setting tool assembly, and the one or more replacement perforating guns from the wellbore.

A twenty-second embodiment, which is the method of the twenty-first embodiment, further comprising structurally compromising the propping component such that the rotatable sealing component (e.g., flapper) can transition to the fully closed position, whereby a wellbore zone below the set zonal isolation device is isolated from fluid flow from the wellbore zone above the set zonal isolation device.

A twenty-third embodiment, which is the method of the twenty-second embodiment, wherein the propping component comprises a degradable material, an erodible material, or an abradable material and is structurally compromised via contact with a flowing wellbore fluid that removes all or a portion of the degradable material, the erodible material, or the abradable material.

A twenty-fourth embodiment, which is the method of the twenty-second embodiment, wherein the propping component comprises a dissolvable material or a corrodible material and is structurally compromised via contact with a wellbore fluid (e.g., via chemical decomposition of the strut, dissolution of the strut, etc.).

A twenty-fifth embodiment, which is the method of the twenty-second embodiment, wherein the propping component comprises a temperature-sensitive material (e.g., a fusible alloy) and is structurally compromised via change in ambient temperature in the wellbore proximate the set zonal isolation plug.

A twenty-sixth embodiment, which is the method of the twenty-fifth embodiment, wherein the change in ambient temperature is controlled by adjusting (e.g., halting) a flow of fluid in the wellbore, thereby allowing the temperature in the wellbore proximate the set zonal isolation plug to increase and soften the temperature-sensitive material.

A twenty-seventh embodiment, which is the method of the twenty-second embodiment, wherein the propping component comprises a frangible material and is structurally compromised via contact with a pressure wave.

A twenty-eighth embodiment, which is the method of the twenty-seventh embodiment, wherein the pressure wave is produced via a fluid pulse from the surface or from firing of a perforating gun (e.g., a shock wave).

A twenty-ninth embodiment, which is the method of the twenty-first embodiment, further comprising applying a closing force on the rotatable sealing component (e.g., flapper) that is greater than a spring force applied by spring 427 and/or spring 445 to transition the rotatable sealing component (e.g., flapper) from the intermediate position to the fully closed position, wherein the closing force results from contact with fluid flowing into the wellbore.

A thirtieth embodiment, which is the method of any of the twenty-second through the twenty-ninth embodiments, further comprising pumping fluid (e.g., a fracturing fluid such as a slickwater, a gel fluid, a proppant-laden fluid) from the surface down the wellbore and into the formation via the plurality of perforations in the wellbore zone above the set zonal isolation device and fracturing the formation, wherein a sealing device such as a ball is not required to be pumped from the surface in order to prevent fluid flow through the zonal isolation device and divert the fluid into the perforations and surrounding formation.

A thirty-first embodiment, which is the method of the thirtieth embodiment, where the rotatable sealing component (e.g., flapper) comprises a rupture disk, rupturing the rupture disk to provide for fluid flow through the set zonal isolation device, wherein the fluid flow enhances the dissolution rate of one or more dissolvable components of the zonal isolation device.

A thirty-second embodiment, which is the method of the thirtieth embodiment, where the rotatable sealing component (e.g., flapper) comprises a releasable hinge, decoupling an end of the rotatable sealing component (e.g., flapper) proximate the releasable hinge to remove the rotatable sealing component (e.g., flapper) from contact with the sealing surface to provide for fluid flow through the set zonal isolation device, wherein the fluid flow enhances the dissolution rate of one or more dissolvable components of the zonal isolation device.

A thirty-third embodiment, which is a method comprising inserting into a cased wellbore the zonal isolation device of any of the first through the twelfth embodiments, actuating the zonal isolation device to provide a set zonal isolation device, detaching a setting tool assembly from the set zonal isolation device, moving the setting tool assembly uphole from the set zonal isolation device, wherein the setting tool assembly is coupled to one or more perforating guns located uphole from the setting tool assembly, sending a trigger signal to the one or more perforating guns, forming a plurality of perforations through the casing and into the surrounding formation in a wellbore zone located above the set zonal isolation device, removing the setting tool assembly and the one or more perforating guns coupled to the setting tool assembly from the wellbore, either (i) structurally compromising the propping component such that the rotatable sealing component (e.g., flapper) can transition to the fully closed position, whereby a wellbore zone below the set zonal isolation device is isolated from fluid flow from the wellbore zone above the set zonal isolation device, wherein the propping component is structurally compromised in accordance with any of the twenty-third through the twenty-eighth embodiments or (ii) applying a closing force on the rotatable sealing component (e.g., flapper) that is greater than a spring force applied by spring 427 and/or spring 445 to transition the rotatable sealing component (e.g., flapper) from the intermediate position to the fully closed position, wherein the closing force results from contact with fluid flowing into the wellbore, and pumping fluid (e.g., a fracturing fluid such as a slickwater, a gel fluid, a proppant-laden fluid) from the surface down the wellbore and into the formation via the plurality of perforations in the wellbore zone above the set zonal isolation device and fracturing the formation, wherein a sealing device such as a ball is not required to be pumped from the surface in order to prevent fluid flow through the zonal isolation device and divert the fluid into the perforations and surrounding formation.

A thirty-fourth embodiment, which is the method of the thirty-second embodiment, where the rotatable sealing component (e.g., flapper) comprises a rupture disk, rupturing the rupture disk to provide for fluid flow through the set zonal isolation device, wherein the fluid flow enhances the dissolution rate of one or more dissolvable components of the zonal isolation device.

A thirty-fifth embodiment, which is the method of the thirty-second embodiment, where the rotatable sealing component (e.g., flapper) comprises a releasable hinge, decoupling an end of the rotatable sealing component (e.g., flapper) proximate the releasable hinge to remove the rotatable sealing component (e.g., flapper) from contact with the sealing surface to provide for fluid flow through the set zonal isolation device, wherein the fluid flow enhances the dissolution rate of one or more dissolvable components of the zonal isolation device.

A thirty-sixth embodiment, which is a method comprising inserting into a cased wellbore the zonal isolation device of any of the thirteenth through the fifteenth embodiments, actuating the zonal isolation device to provide a set zonal isolation device, wherein the rotatable sealing component (e.g., flapper) transitions to the fully closed position and a wellbore zone below the set zonal isolation device is isolated from fluid flow from a wellbore zone above the set zonal isolation device, detaching a setting tool assembly from the set zonal isolation device, moving the setting tool assembly uphole from the set zonal isolation device, wherein the setting tool assembly is coupled to one or more perforating guns located uphole from the setting tool assembly, sending a trigger signal to the one or more perforating guns, forming a plurality of perforations through the casing and into the surrounding formation in a wellbore zone located above the set zonal isolation device, removing the setting tool assembly and the one or more perforating guns coupled to the setting tool assembly from the wellbore, pumping fluid (e.g., a fracturing fluid such as a slickwater, a gel fluid, a proppant-laden fluid) from the surface down the wellbore and into the formation via the plurality of perforations in the wellbore zone above the set zonal isolation device and fracturing the formation, wherein a sealing device such as a ball is not required to be pumped from the surface in order to prevent fluid flow through the set zonal isolation device and divert the fluid into the perforations and surrounding formation, and rupturing the rupture disk to provide for fluid flow through the set zonal isolation device, wherein the fluid flow enhances the dissolution rate of one or more dissolvable components of the zonal isolation device.

A thirty-seventh embodiment, which is a method comprising inserting into a cased wellbore the zonal isolation device of any of the sixteenth through the eighteenth embodiments, actuating the zonal isolation device to provide a set zonal isolation device, wherein the rotatable sealing component (e.g., flapper) transitions to the fully closed position and a wellbore zone below the set zonal isolation device is isolated from fluid flow from a wellbore zone above the set zonal isolation device, detaching a setting tool assembly from the set zonal isolation device, moving the setting tool assembly uphole from the set zonal isolation device, wherein the setting tool assembly is coupled to one or more perforating guns located uphole from the setting tool assembly, sending a trigger signal to the one or more perforating guns, forming a plurality of perforations through the casing and into the surrounding formation in a wellbore zone located above the set zonal isolation device, removing the setting tool assembly and the one or more perforating guns coupled to the setting tool assembly from the wellbore, pumping fluid (e.g., a fracturing fluid such as a slickwater, a gel fluid, a proppant-laden fluid) from the surface down the wellbore and into the formation via the plurality of perforations in the wellbore zone above the set zonal isolation device and fracturing the formation, wherein a sealing device such as a ball is not required to be pumped from the surface in order to prevent fluid flow through the set zonal isolation device and divert the fluid into the perforations and surrounding formation, and decoupling an end of the rotatable sealing component (e.g., flapper) proximate the releasable hinge to remove the rotatable sealing component (e.g., flapper) from contact with the sealing surface to provide for fluid flow through set zonal isolation device, wherein the fluid flow enhances the dissolution rate of one or more dissolvable components of the zonal isolation device.

A thirty-eighth embodiment, which is a zonal isolation device 200 comprising: a sealing element 100 comprising a deformable material and an inner bore 105; a support ring 190 (also referred to as a frustrum having a conical shape) movably disposed within the inner bore 105 of the sealing element 100; a rotatable seal connected to the support ring 190 and configured to engage a sealing surface (e.g., face or seat) of support ring 190, wherein the flapper is configured to restrict fluid flow through the zonal isolation device 200 in a closed position, is configured to minimally restrict fluid flow through the zonal isolation device 200 in a fully open position an end element 170 (e.g., a mule shoe) adjacent the anchoring assembly 215.

A thirty-ninth embodiment, which is the zonal isolation device of the thirty-eighth embodiment wherein the rotatable member allows restricted fluid flow through the zonal isolation device 200 when held by a propping component (also referred to as a propping member) in an intermediate or partially open position.

A fortieth embodiment, which is a zonal isolation device 200 comprising: a sealing element 100 comprising a deformable material and an inner bore 105; a support ring movably disposed within the inner bore 105 of the sealing element 100; a rotatable sealing component 400 coupled to the support ring 190 and configured to engage a sealing surface of the support ring 190, wherein the rotatable sealing component blocks fluid flow through the zonal isolation device 200 in a fully closed position, allows unrestricted fluid flow through the zonal isolation device 200 in a fully open position, and allows restricted fluid flow through the zonal isolation device 200 when held by a propping component in an intermediate or partially open position.

A forty-first embodiment, which is the device of the fortieth embodiment, wherein the rotatable sealing component 400 is a flapper valve.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the spirit of the subject matter defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. In particular, every range of values (e.g., "from about a to about b," or, equivalently, "from approximately a to b," or, equivalently, "from approximately a-b") disclosed herein is to be understood as referring to the power set (the set of all subsets) of the respective range of values. The terms in the claims have their plain, ordinary meaning unless otherwise explicitly and clearly defined by the patentee.

What is claimed is:

1. A zonal isolation device comprising:

a sealing element comprising a deformable material and an inner bore;

a support ring movably disposed within the inner bore of the sealing element, wherein upon setting of the zonal isolation device the support ring moves axially within the inner bore of the sealing element and deforms the sealing element in the radial direction; and a rotatable sealing component coupled to the support ring and configured to engage a sealing surface of the support ring, wherein the rotatable sealing component blocks fluid flow through the zonal isolation device in a fully closed position, allows unrestricted fluid flow through the zonal isolation device in a fully open position, and allows restricted fluid flow through the zonal isolation device when held by a propping component in an intermediate or partially open position.

2. The device of claim 1, wherein the rotatable sealing component is a flapper valve.

3. The device of claim 2, wherein the propping component comprises a spring.

4. The device of claim 3, wherein the spring is a torsion spring, wherein the torsion spring is positioned adjacent a hinged end of the flapper and wherein the torsion spring holds the flapper in the intermediate position when the torsion spring is in a neutral or equilibrium condition, thereby allowing fluid flow via a gap formed between a flapper end and the sealing surface.

5. The device of claim 3, wherein the spring is a coil spring, wherein a first end of the coil spring is received within a recess in the uphole end of the support ring and a second end of the coil spring contacts a flapper end, wherein the coil spring holds the flapper in the intermediate position when the coil spring is in a neutral or equilibrium condition, thereby allowing fluid flow via a gap formed between the flapper end and the sealing surface.

6. The device of claim 2, wherein the propping component comprises a strut.

7. The device of claim 6, wherein a first end of the strut is received within a recess in the uphole end of the support ring and a second end of the strut contacts flapper end, wherein the strut holds the flapper in the intermediate position, thereby allowing fluid flow via a gap formed between flapper end and the sealing surface.

8. The device of claim 7, wherein the strut comprises a dissolvable material, a degradable material, an erodible material, an abradable material, a temperature-sensitive material, a corrodible material, a frangible material, or combinations thereof and is configured such that the strut loses structural integrity when subjected to contact with a wellbore fluid, downhole ambient conditions, or both, thereby allowing the flapper to transition from the intermediate position to the fully closed position.

9. The device of claim 2, wherein the flapper further comprises a rupture disk.

10. The device of claim 9, wherein the rupture disk is disposed within a circumferential groove on an interior face of a hole passing through the flapper.

11. The device of claim 2, wherein the flapper further comprises a releasable hinge configured to decouple an end of the flapper proximate the releasable hinge.

12. The device of claim 11, wherein the releasable hinge comprises a pivot pin and wherein the end of the flapper proximate the releasable hinge comprises a u-shaped recess receiving the pivot pin and a clip engaging the pivot pin, wherein the flapper is configured to decouple from the releasable hinge via application of a releasing force sufficient to overcome a retaining force applied to the releasable hinge by the clip.

13. The device of claim 1, further comprising:

a wedge engaged with a downhole end of the sealing element;

an anchoring assembly engaged with the wedge; and an end element adjacent the anchoring assembly.

14. A method comprising:

inserting into a cased wellbore a zonal isolation device comprising:

a sealing element comprising a deformable material and an inner bore;

a support ring movably disposed within the inner bore of the sealing element, wherein upon setting of the zonal isolation device the support ring moves axially within the inner bore of the sealing element and deforms the sealing element in the radial direction; and a rotatable sealing component coupled to the support ring and configured to engage a sealing surface of the support ring, wherein the rotatable sealing component blocks fluid flow through the zonal isolation device in a fully closed position, allows unrestricted fluid flow through the zonal isolation device in a fully open position, and allows restricted fluid flow through the zonal isolation device when held by a propping component in an intermediate or partially open position;

actuating the zonal isolation device to provide a set zonal isolation device;

detaching a setting tool assembly from the set zonal isolation device;

moving the setting tool assembly uphole from the set zonal isolation device, wherein the setting tool assembly is coupled to one or more perforating guns located uphole from the setting tool assembly;

sending a trigger signal to the one or more perforating guns; and upon failure of at least one of the perforating guns to fire, pumping one or more replacement perforating guns down the wellbore to a desired location, wherein, during the pumping, the propping component holds the rotatable sealing component in the intermediate position and provides for restricted flow of a wellbore fluid through the zonal isolation device.

15. The method of claim 14, further comprising:

sending a trigger signal to the one or more replacement perforating guns;

forming a plurality of perforations through the casing and into the surrounding formation in a wellbore zone located above the set zonal isolation device;

removing the setting tool assembly, the one or more perforating guns coupled to the setting tool assembly, and the one or more replacement perforating guns from the wellbore; and structurally compromising the propping component such that the rotatable component can transition to the fully closed position, whereby a wellbore zone below the set zonal isolation device is isolated from fluid flow from the wellbore zone above the set zonal isolation device.

16. The method of claim 15, wherein the rotatable sealing component is a flapper.

* * * * *